US011717067B1

(12) United States Patent
Piper et al.

(10) Patent No.: US 11,717,067 B1
(45) Date of Patent: Aug. 8, 2023

(54) CASE SYSTEM FOR PORTABLE ELECTRONIC DEVICE

(71) Applicant: Pioneer Square Brands, Inc., Seattle, WA (US)

(72) Inventors: Brian Lewis Piper, Seattle, WA (US); Jaimie Emerald Chan, Renton, WA (US)

(73) Assignee: Pioneer Square Brands, Inc., McLean, VA (US)

( * ) Notice: Subject to any disclaimer, the term of this patent is extended or adjusted under 35 U.S.C. 154(b) by 0 days.

(21) Appl. No.: 18/105,200

(22) Filed: Feb. 2, 2023

(51) Int. Cl.
*A45C 11/00* (2006.01)
*A45C 13/00* (2006.01)

(52) U.S. Cl.
CPC ..... *A45C 11/00* (2013.01); *A45C 13/002* (2013.01); *A45C 2011/002* (2013.01); *A45C 2011/003* (2013.01)

(58) Field of Classification Search
CPC . A45C 11/00; A45C 13/002; A45C 2011/002; A45C 2011/003; B65D 81/053
USPC ..... 206/320, 586; 248/688, 689
See application file for complete search history.

(56) References Cited

U.S. PATENT DOCUMENTS 8,403,136 B1 * 3/2013 Tsai ..... G06F 1/1656 455/575.8
8,469,189 B2 * 6/2013 Liang ..... G06F 1/1656 206/320
11,402,874 B1 * 8/2022 Giazzon ..... G06F 1/1656
2007/0138041 A1 * 6/2007 Welsh ..... B25H 3/02 206/349
2013/0105662 A1 * 5/2013 Cote ..... F16M 11/041 248/689
2020/0150727 A1 * 5/2020 Ho ..... B29C 66/7292
2022/0273081 A1 * 9/2022 Matthews, Jr. ..... G06F 1/1616
2022/0382332 A1 * 12/2022 Ho ..... A45C 11/00

FOREIGN PATENT DOCUMENTS

EP 3729991 A1 * 10/2020 ..... A45C 11/00
KR 2015000111 U * 1/2015
WO WO-2022259029 A1 * 12/2022

* cited by examiner

*Primary Examiner* — Rafael A Ortiz
(74) *Attorney, Agent, or Firm* — Grandview Law

(57) ABSTRACT

Systems and methods involve implementations such as a first aperture extending through an interior base surface and an exterior base surface, and a second aperture extending through the interior base surface and the exterior base surface, wherein the first aperture includes a first plan-view shape and the second aperture includes a second plan-view shape, the first plan-view shape of the first aperture being different that the second plan-view shape of the second aperture; and a bumper assembly including a first engagement member sized and shaped to couple with the first aperture and the least one second engagement member sized and shaped to couple with the second aperture. In addition, other aspects are described in the claims, drawings, and text forming a part of the present disclosure.

17 Claims, 25 Drawing Sheets

CASE SYSTEM FOR PORTABLE ELECTRONIC DEVICE

SUMMARY

In one or more aspects a system for a portable electronic computing device, the system including (I) a case assembly including (A) at least one base including at least one interior base surface and at least one exterior base surface, (B) a first side including at least one first wall portion angularly extending relative to the at least one interior base surface, (C) a second side including at least one second wall portion angularly extending relative to the at least one interior base surface, and (D) a third side including at least one third wall portion angularly extending relative to the at least one interior base surface, wherein the at least one first wall portion extends perpendicularly to the second wall portion, wherein the at least one first wall portion extends parallel with the at least one third interior wall portion, and (E) at least one corner assembly including (i) at least one first aperture extending through the at least one interior base surface and the at least one exterior base surface, and (ii) at least one second aperture extending through the at least one interior base surface and the at least one exterior base surface, wherein the at least one first aperture includes a first plan-view shape and the at least one second aperture includes a second plan-view shape, the first plan-view shape of the first aperture being different that the second plan-view shape of the second aperture; and (II) at least one bumper assembly including at least one first engagement member sized and shaped to couple with the at least one first aperture and the at least one second engagement member sized and shaped to couple with the at least one second aperture. Wherein the first plan-view shape of the at least one first aperture being rectangular in shape. Wherein the second plan-view shape of the at least one second aperture being circular in shape. Wherein the at least one corner assembly being positioned equidistant from the at least one first wall portion and the at least one second wall portion, and wherein the at least one first aperture being positioned closer to the at least one first wall portion than the at least one second wall portion. Wherein the at least one corner assembly being positioned equidistant from the at least one first wall portion and the at least one second wall portion, and wherein the at least one second aperture being positioned equidistant from the at least one first wall portion and from the at least one second wall portion. Wherein the at least one bumper assembly includes a first elongated portion, a second elongated portion, and a corner portion, and wherein the first elongated portion extends from the corner portion in a first direction, and the second elongated portion extends from the corner portion in a second direction perpendicular to the first direction. Wherein at least one of the at least one first engagement member extends from the first elongated portion of the at least one bumper assembly and at least one of the at least one first engagement member extends from the second elongated portion of the at least one bumper assembly, and wherein the at least one second engagement member extend from the corner portion of the at least one bumper assembly. Wherein the at least one interior base surface includes at least one first surface and at least one second surface, wherein the at least one first aperture extending through the at least one second surface and the at least one second aperture extending through the at least one second surface, and wherein the at least one second surface being recessed from the at least one first surface sufficiently to allow any portion of the at least one first engagement member and any portion of the at least one second engagement member to refrain from being parallel with any portion of the first wall portion, the second wall portion, and the third wall portion. Wherein the at least one exterior base surface includes at least one first surface and at least one second surface, wherein the at least one first aperture extending through the at least one second surface and the at least one second aperture extending through the at least one second surface, and wherein the at least one second surface being recessed from the at least one first surface sufficiently to allow at least one portion of the at least one bumper assembly other than the at least one first engagement member and other than the at least one second engagement member to be recessed from the at least one first surface when the at least one bumper assembly is coupled with the case assembly. Wherein at least one the first engagement portion of the at least one bumper assembly includes at least one rectangular portion. Wherein the at least one first engagement portion of the at least one bumper assembly includes at least one flange extending from and along the at least one rectangular portion of the at least one first engagement portion. Wherein the at least one second engagement portion of the at least one bumper assembly includes at least one cylindrical portion. Wherein a first of the at least one first engagement member being positioned adjacent to and extending away from the at least one second engagement member in a first direction, and wherein a second of the at least one first engagement member being positioned adjacent to and extending away from the at least one second engagement member in a second direction perpendicular to the first direction. Wherein the at least one second engagement member includes a circular flange portion, and wherein the at least one second engagement member includes a beveled circular portion as an end portion. Wherein the at least one second engagement member includes a circular flange portion as an end portion.

In one or more aspects, a system including (I). (I) a case assembly including (A) at least one base including at least one interior base surface and at least one exterior base surface, (B) a first side including at least one first wall portion angularly extending relative to the at least one interior base surface, (C) a second side including at least one second wall portion angularly extending relative to the at least one interior base surface, and (D) a third side including at least one third wall portion angularly extending relative to the at least one interior base surface, wherein the at least one first wall portion extends perpendicularly to the second wall portion, wherein the at least one first wall portion extends parallel with the at least one third interior wall portion, and (E) at least one corner assembly including (i) at least one first aperture extending through the at least one interior base surface and the at least one exterior base surface, and (ii) at least one second aperture extending through the at least one interior base surface and the at least one exterior base surface, wherein the at least one first aperture includes a rectangular plan-view shape and the at least one second aperture includes a circular plan-view shape. Wherein the at least one corner assembly being positioned equidistant from the at least one first wall portion and the at least one second wall portion, wherein the at least one first aperture being positioned closer to the at least one first wall portion than the at least one second wall portion, and wherein the at least one second aperture being positioned equidistant from the at least one first wall portion and from the at least one second wall portion. Wherein the at least one interior base surface includes at least one first surface and at least one second surface, wherein the at least one first aperture extending through the at least one second surface and the at least one second aperture extending through the at least one second surface, and wherein the at least one second surface being recessed from the at least one first surface.

In one or more aspects, a system including (I) a case assembly including (A) at least one base including at least one interior base surface and at least one exterior base surface, and (E) at least one corner assembly including (i) at least one first aperture extending through the at least one interior base surface and the at least one exterior base surface, and (ii) at least one second aperture extending through the at least one interior base surface and the at least one exterior base surface, wherein the at least one first aperture includes a first plan-view shape and the at least one second aperture includes a second plan-view shape, the first plan-view shape of the first aperture being different that the second plan-view shape of the second aperture; and (II) at least one bumper assembly including at least one first engagement member sized and shaped to couple with the at least one first aperture and the at least one second engagement member sized and shaped to couple with the at least one second aperture, wherein the at least one bumper assembly includes a first elongated portion, a second elongated portion, and a corner portion, and wherein the first elongated portion extends from the corner portion in a first direction, and the second elongated portion extends from the corner portion in a second direction perpendicular to the first direction. Wherein at least one of the at least one first engagement member extends from the first elongated portion of the at least one bumper assembly and at least one of the at least one first engagement member extends from the second elongated portion of the at least one bumper assembly, and wherein the at least one second engagement member extend from the corner portion of the at least one bumper assembly.

In addition to the foregoing, other aspects are described in the claims, drawings, and text forming a part of the disclosure set forth herein. Various other aspects are set forth and described in the teachings such as text (e.g., claims and/or detailed description) and/or drawings of the present disclosure. The foregoing is a summary and thus may contain simplifications, generalizations, inclusions, or omissions of detail; consequently, those skilled in the art will appreciate that the summary is illustrative only and is NOT intended to be in any way limiting. Other aspects, features, and advantages of the devices and/or processes and/or other subject matter described herein will become apparent in the teachings set forth herein.

BRIEF DESCRIPTION OF THE FIGURES

For a more complete understanding of implementations, reference now is made to the following descriptions taken in connection with the accompanying drawings. The use of the same symbols in different drawings typically indicates similar or identical items, unless context dictates otherwise.

With reference now to the figures, shown are one or more examples of a case stylus system for portable electronic device systems, articles of manufacture, compositions of matter for same that may provide context, for instance, in introducing one or more processes and/or devices described herein.

DETAILED DESCRIPTION

Figure 1:
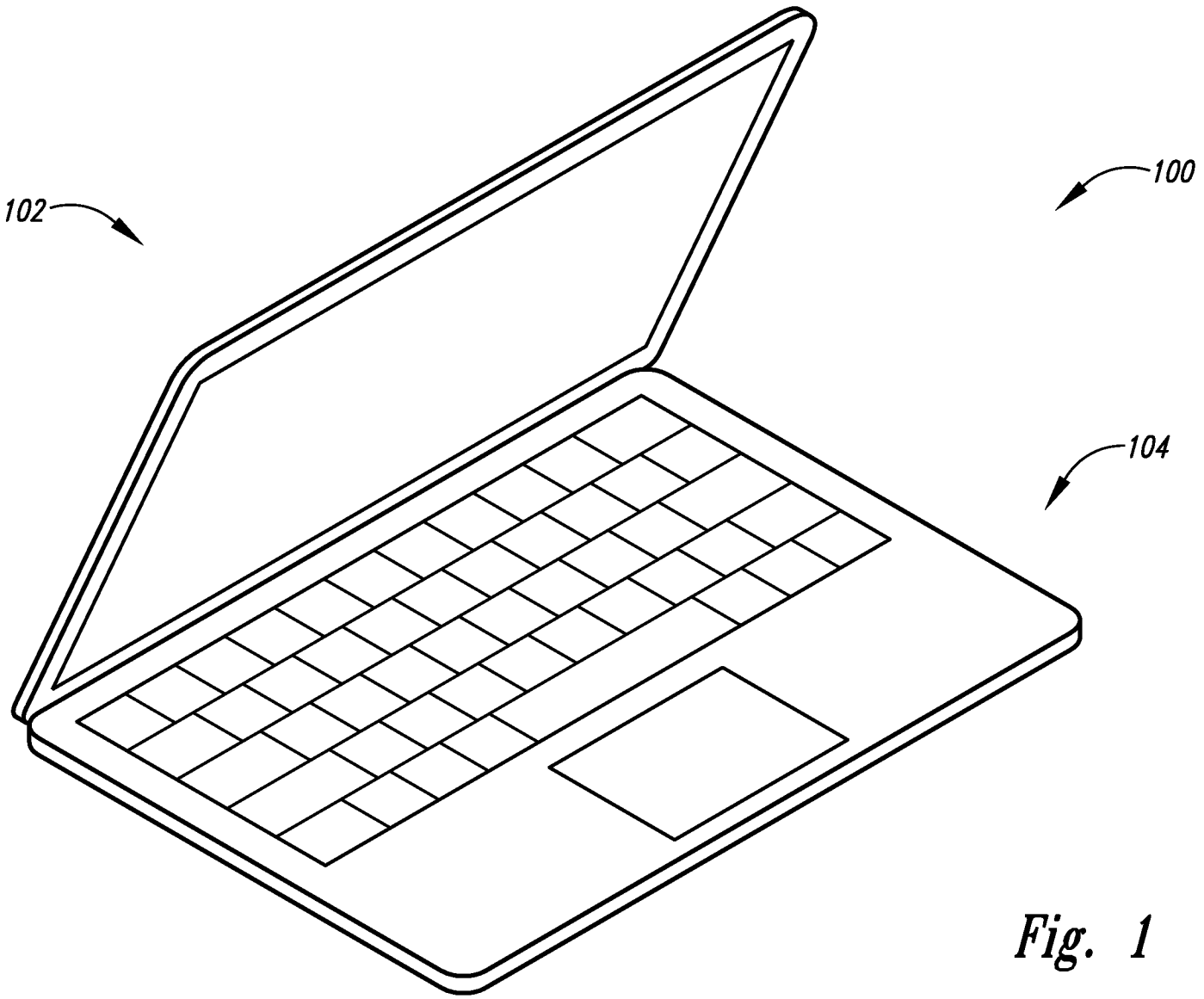
FIG. 1 is a front perspective view of a portable electronic device.

In the following detailed description, reference is made to the accompanying drawings, which form a part hereof. In the drawings, similar symbols typically identify similar components, unless context dictates otherwise. The illustrative implementations described in the detailed description, drawings, and claims are not meant to be limiting. Other implementations may be utilized, and other changes may be made, without departing from the spirit or scope of the subject matter presented here.

Turning to FIG. 1, depicted therein is a front perspective view of portable electronic device 100. In implementations, portable electronic device 100 is shown to include display portion 102, and keyboard portion 104. Implementations can include portable electronic device 100 being a tablet, laptop, mobile phone, etc.

Figure 2:
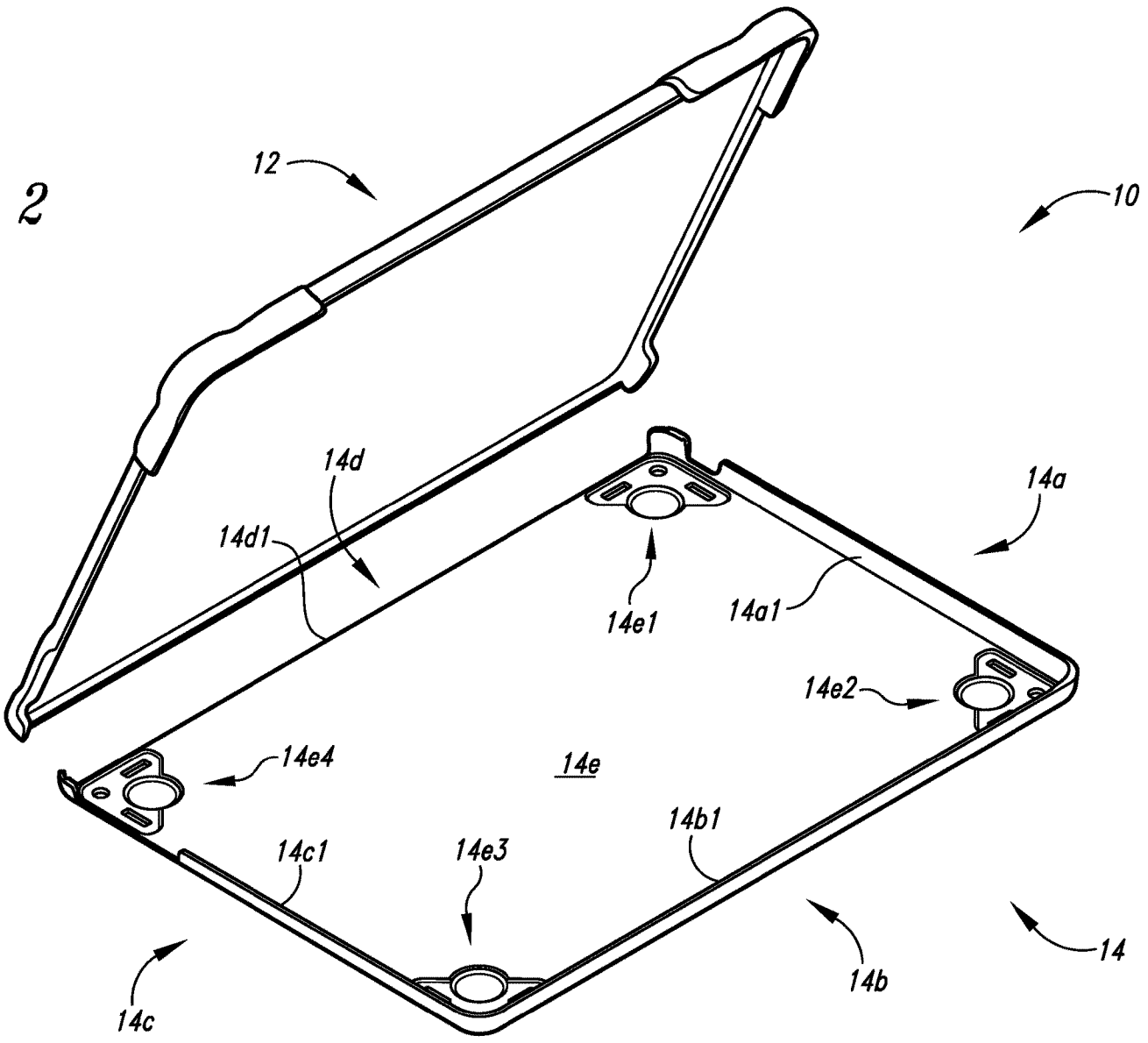
FIG. 2 is a front perspective view of a device case assembly configured to contain the portable electronic device of FIG. 1.

Turning to FIG. 2, depicted therein is a front perspective view of device case assembly 10 configured to contain portable electronic device 100. In implementations, device case assembly 10 is shown to include display containing portion 12, and keyboard containing portion 14. In implementations keyboard containing portion 14 is shown to include side 14*a* with wall 14*a*1, side 14*b* with wall 14*b*1, side 14*c* with wall 14*c*1, side 14*d* with edge 14*d*1, side 14*d* with edge 14*d*1, and base interior surface 14*e* with corner assembly 14*e*1, corner assembly 14*e*2, corner assembly 14*e*3, and corner assembly 14*e*4. Implementations of one or more portions of device case assembly 10 can include at least one of the following materials: rigid plastic, polycarbonate, acrylonitrile butadiene styrene, thermoplastic polymer, thermoplastic polyurethane, polyethylene terephthalate, and nylon.

Figure 3:
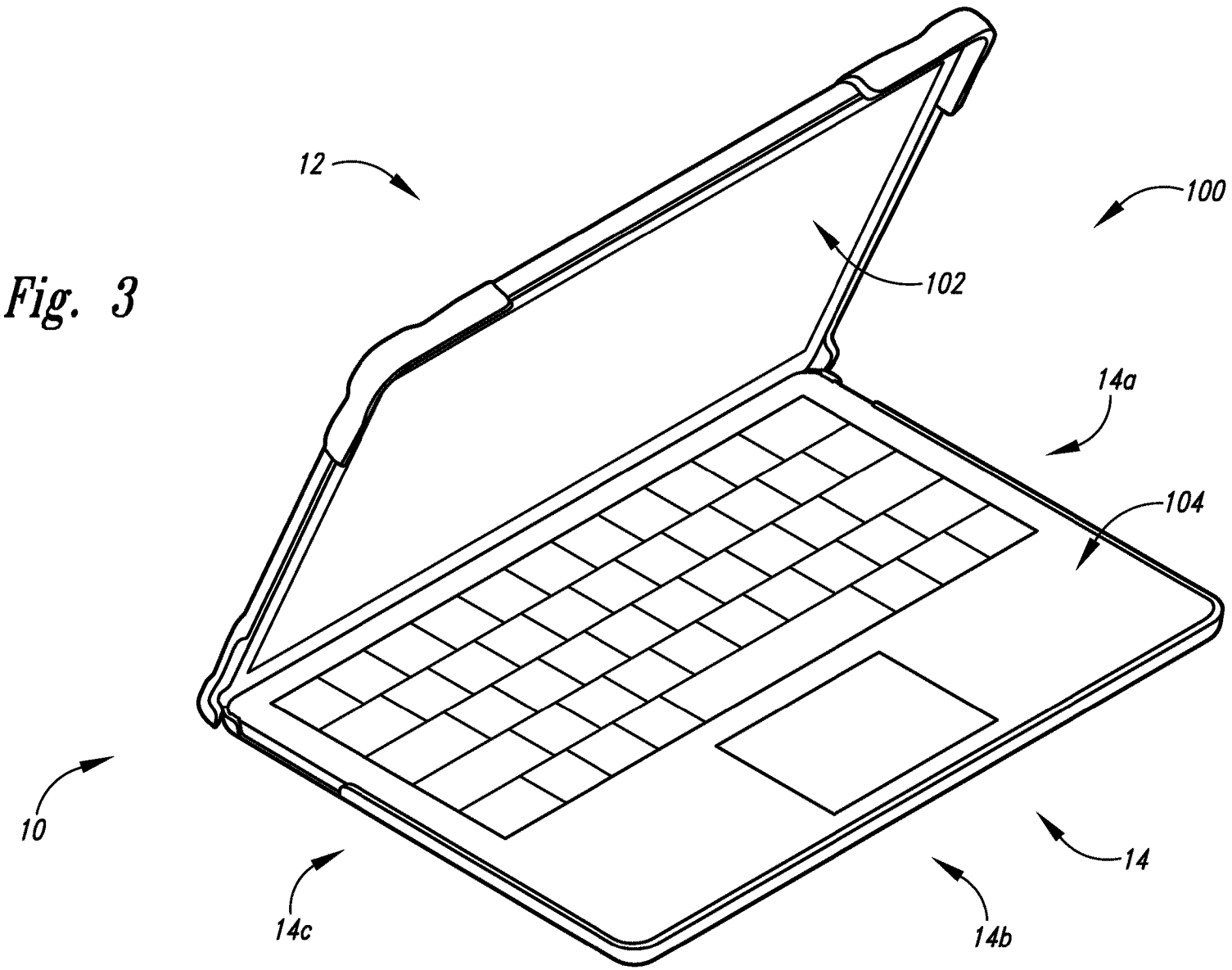
FIG. 3 is a front perspective view of the device case assembly of FIG. 2 shown containing the portable electronic device of FIG. 1.

Turning to FIG. 3, depicted therein is a front perspective view of device case assembly 10 shown containing portable electronic device 100.

Figure 4:
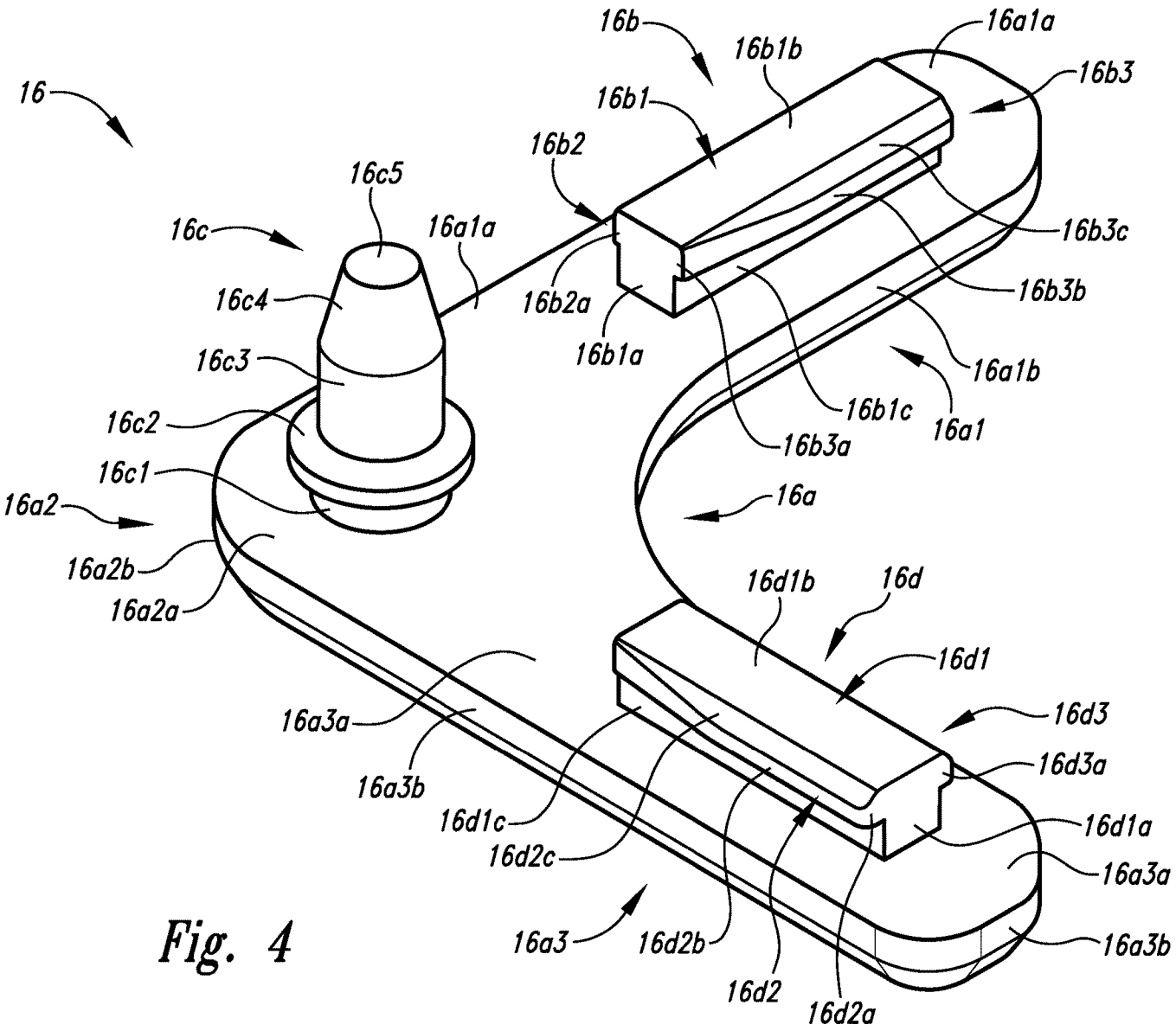
FIG. 4 is a rear perspective view of a bumper assembly.

Turning to FIG. 4, depicted therein is a rear perspective view of bumper assembly 16 shown to include base 16*a*, engagement member 16*b*, engagement member 16*c*, and engagement member 16*d*. Implementations of one or more portions of bumper assembly 16 can include at least one of the following materials: rigid plastic, polycarbonate, acrylonitrile butadiene styrene, thermoplastic polymer, thermoplastic polyurethane, polyethylene terephthalate, and nylon.

In implementations base 16*a* is shown to include elongated portion 16*a*1 with interior surface portion 16*a*1*a* and side portion 16*a*1*b*; corner portion 16*a*2 with interior surface portion 16*a*2*a* and side portion 16*a*2*b*; and elongated portion 16*a*3 with interior surface portion 16*a*3*a* and side portion 16*a*3*b*.

In implementations engagement member 16*b* is shown to include rectangular portion 16*b*1 with end portion 16*b*1*a*, surface portion 16*b*1*b*, and side portion 16*b*1*c*; flange 16*b*2 with end portion 16*b*2*a*; flange 16*b*3 with end portion 16*b*3*a*, side portion 16*b*3*b*, and tapered portion 16*b*3*c*.

In implementations engagement member 16*c* is shown to include cylindrical portion 16*c*1, circular flange 16*c*2, surface portion 16*b*1*b*, cylindrical portion 16*c*3, tapered cylindrical portion 16*c*4, and end portion 16*c*5.

In implementations engagement member 16*d* is shown to include rectangular portion 16*d*1 with end portion 16*d*1*a*, surface portion 16*d*1*b*, and side portion 16*d*1*c*; flange 16*d*2 with end portion 16*d*2*a*, side portion 16*d*2*b*, and tapered portion 16*d*2*c*; and flange 16*b*3 with end portion 16*b*3*a*.

Figure 5:
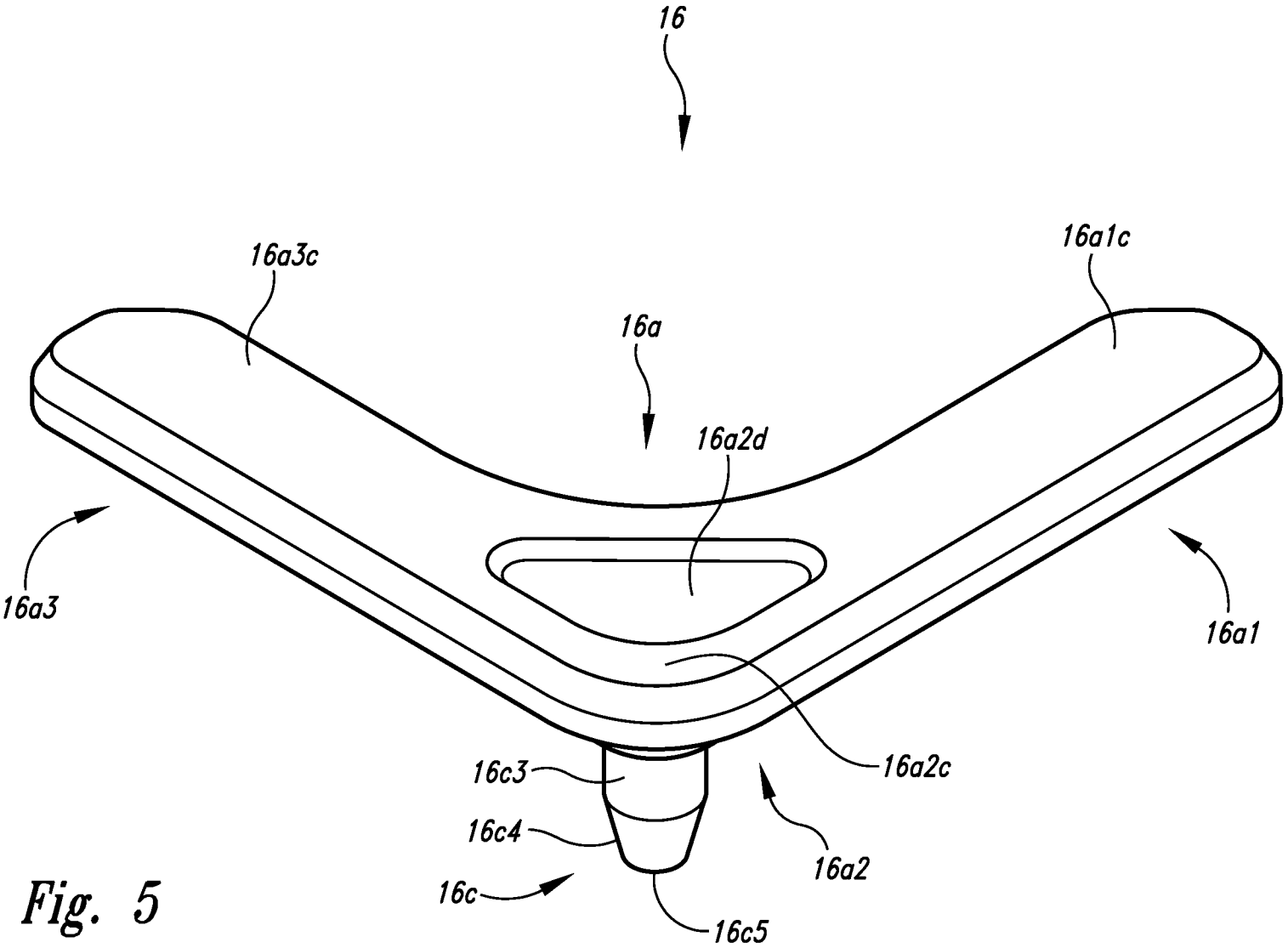
FIG. 5 is a front perspective view of the bumper assembly of FIG. 4.
Figure 6:
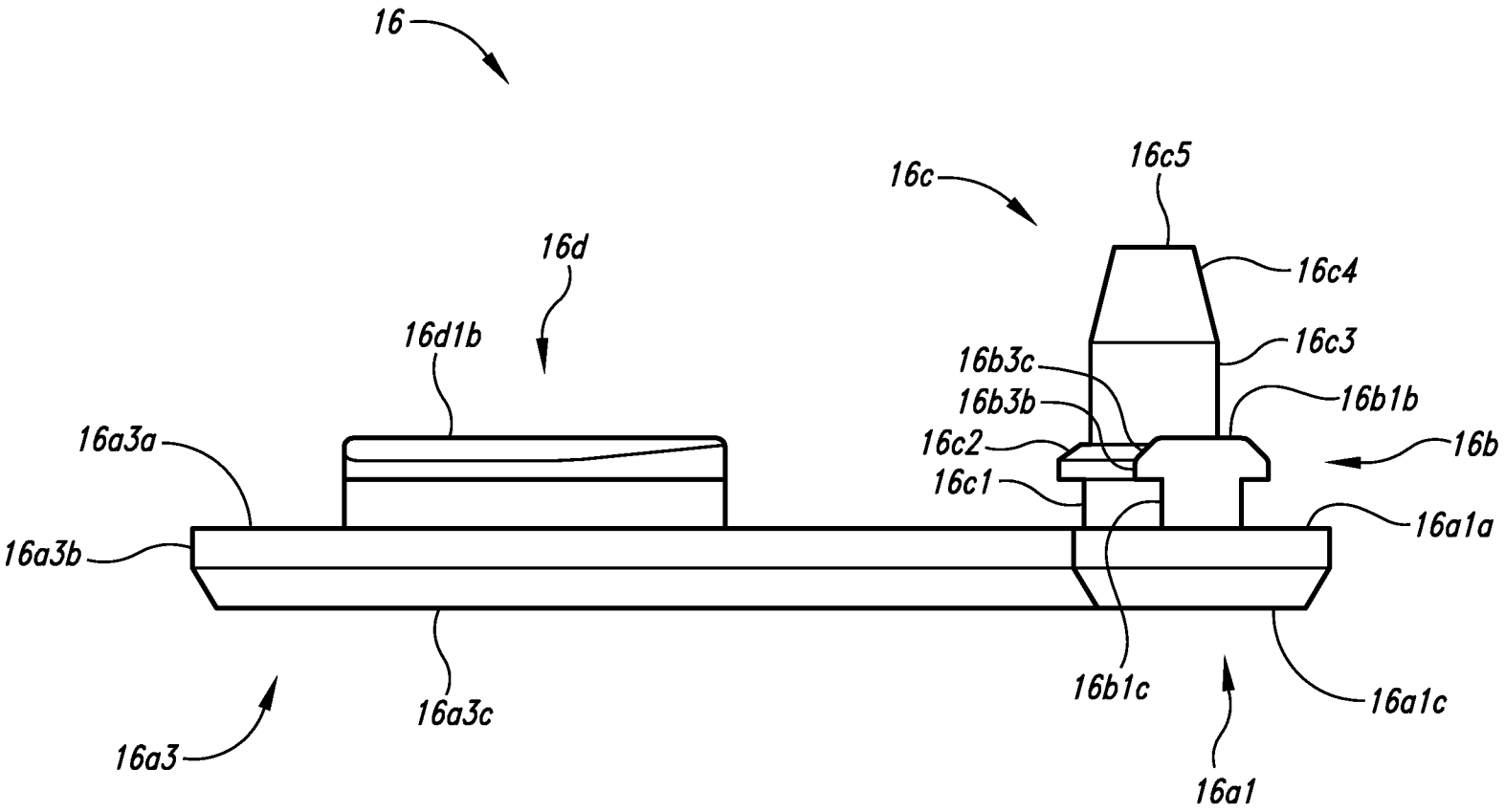
FIG. 6 is a first side-elevational view of the bumper assembly of FIG. 4.

Turning to FIG. 5, depicted therein is a front perspective view of bumper assembly 16, wherein elongated portion 16*a*1 of base 16*a* of bumper assembly 16 is shown to include exterior surface portion 16*a*1*c*, wherein elongated portion 16*a*1 of base 16*a* of bumper assembly 16 is shown to include exterior surface portion 16*a*1*c* and, Turning to FIG. 6, depicted therein is a first side-elevational view of bumper assembly 16.

Figure 7:
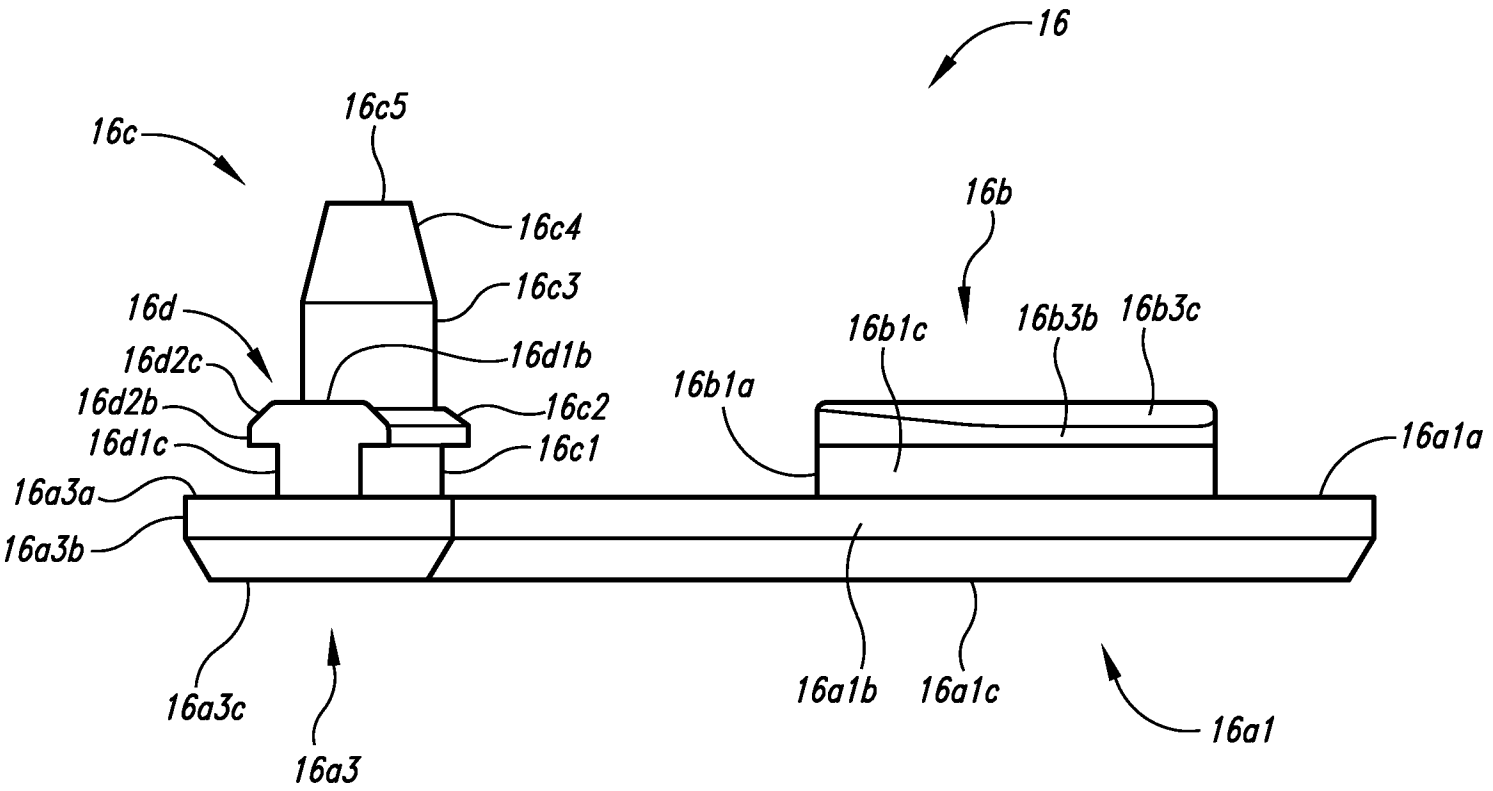
FIG. 7 is a second side-elevational view of the bumper assembly of FIG. 4.

Turning to FIG. 7, depicted therein is a second side-elevational view of bumper assembly 16.

Figure 8:
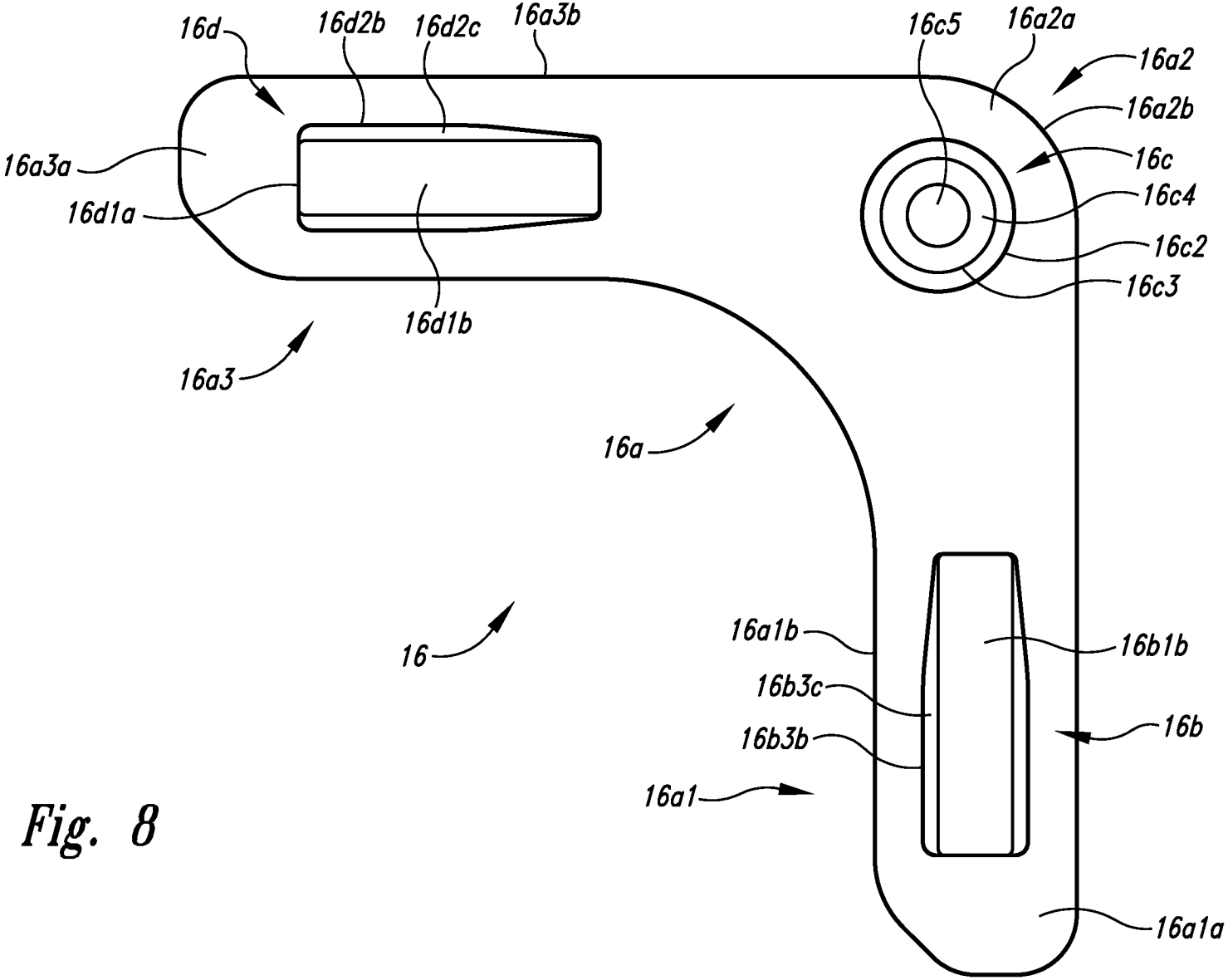
FIG. 8 is a top-plan view of the bumper assembly of FIG. 4.

Turning to FIG. 8, depicted therein is a top-plan view of bumper assembly 16.

Figure 9:
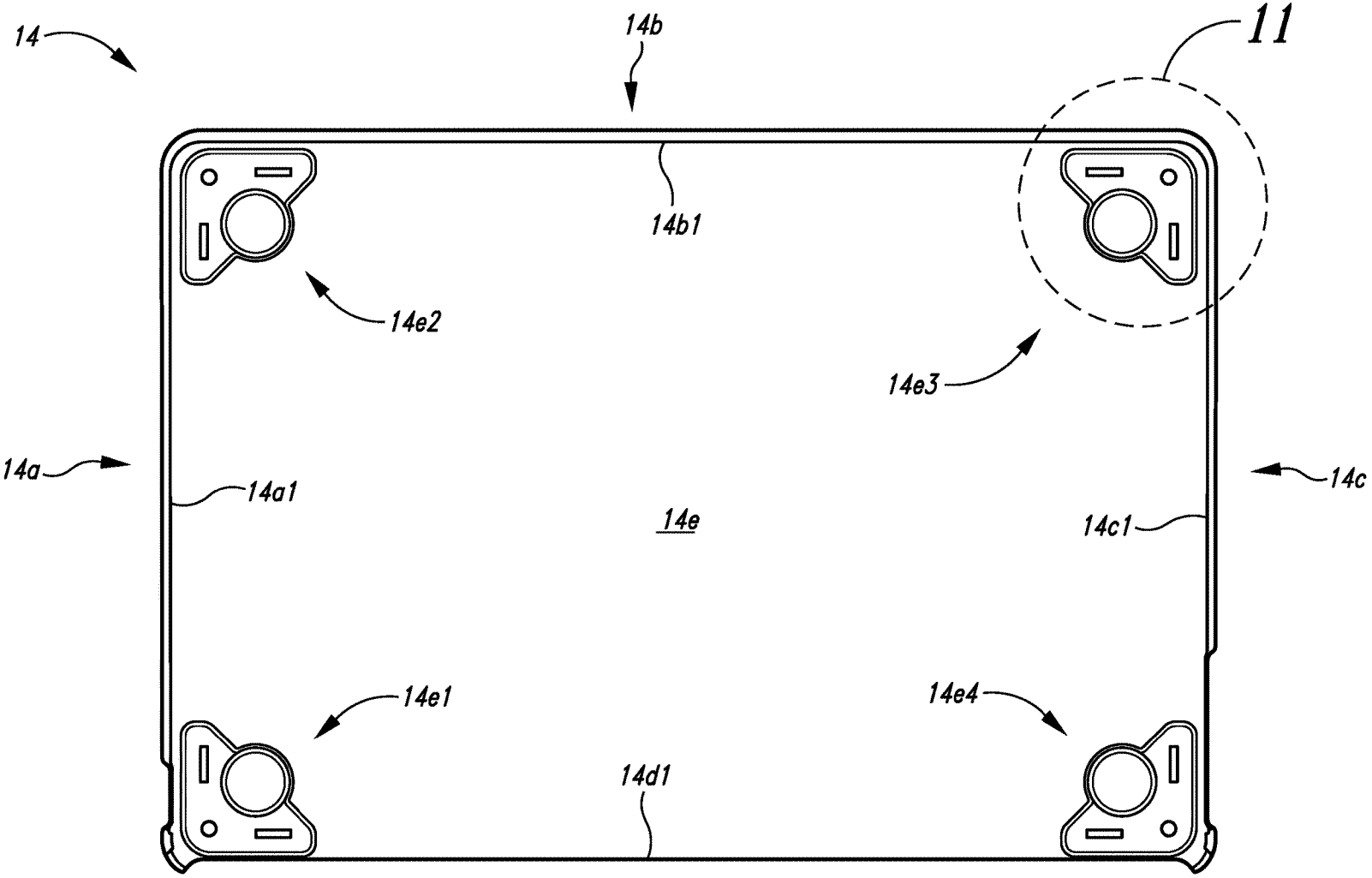
FIG. 9 is a top-plan view of a keyboard portion of the device case assembly of FIG. 2.

Turning to FIG. 9, depicted therein is a top-plan view of keyboard containing portion 14 of device case assembly 10.

Figure 10:
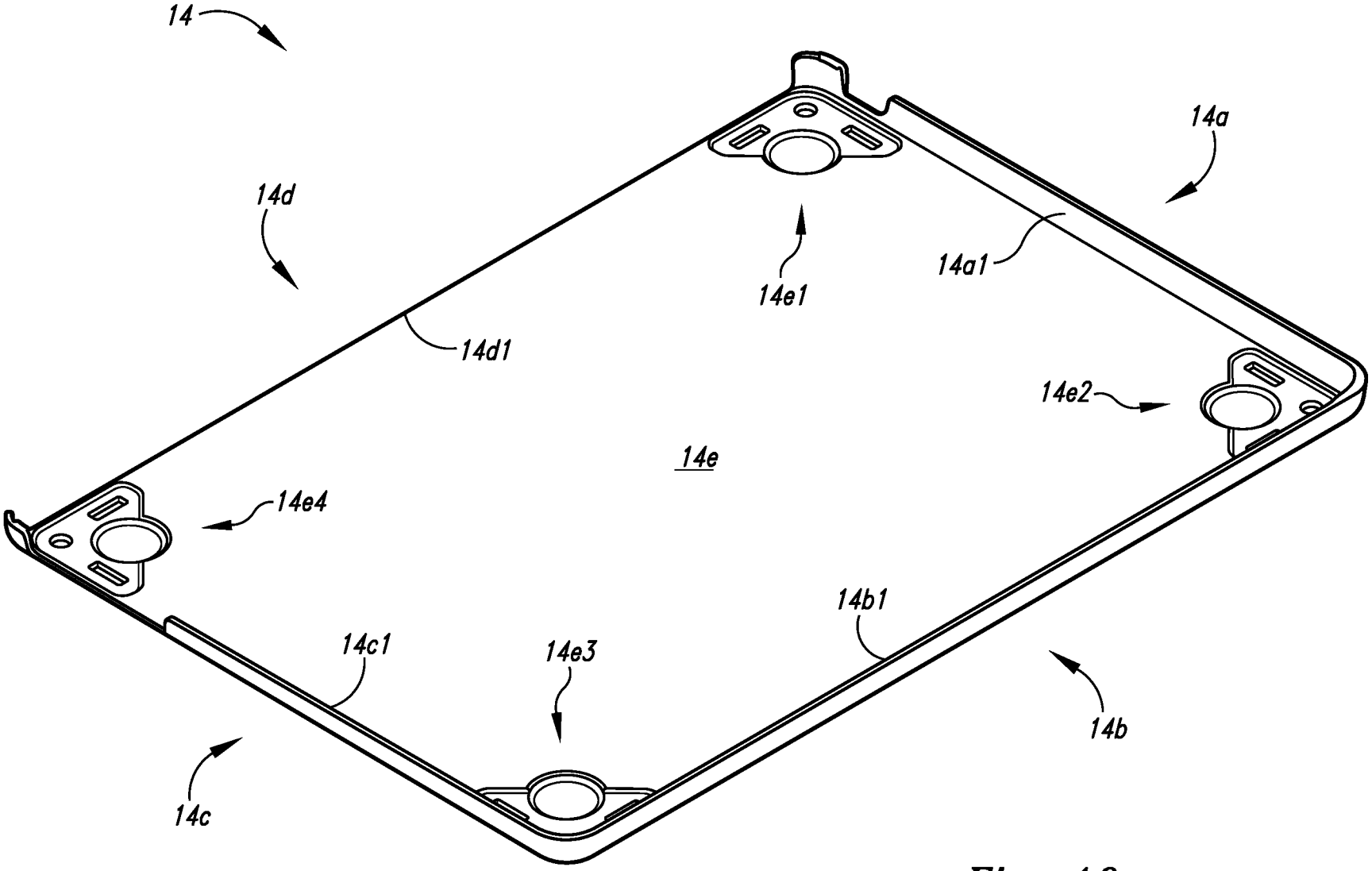
FIG. 10 is a front perspective view of the keyboard portion of FIG. 9 of the device case assembly of FIG. 2.

Turning to FIG. 10, depicted therein is a front perspective view of keyboard containing portion 14 of device case assembly 10.

Figure 11:
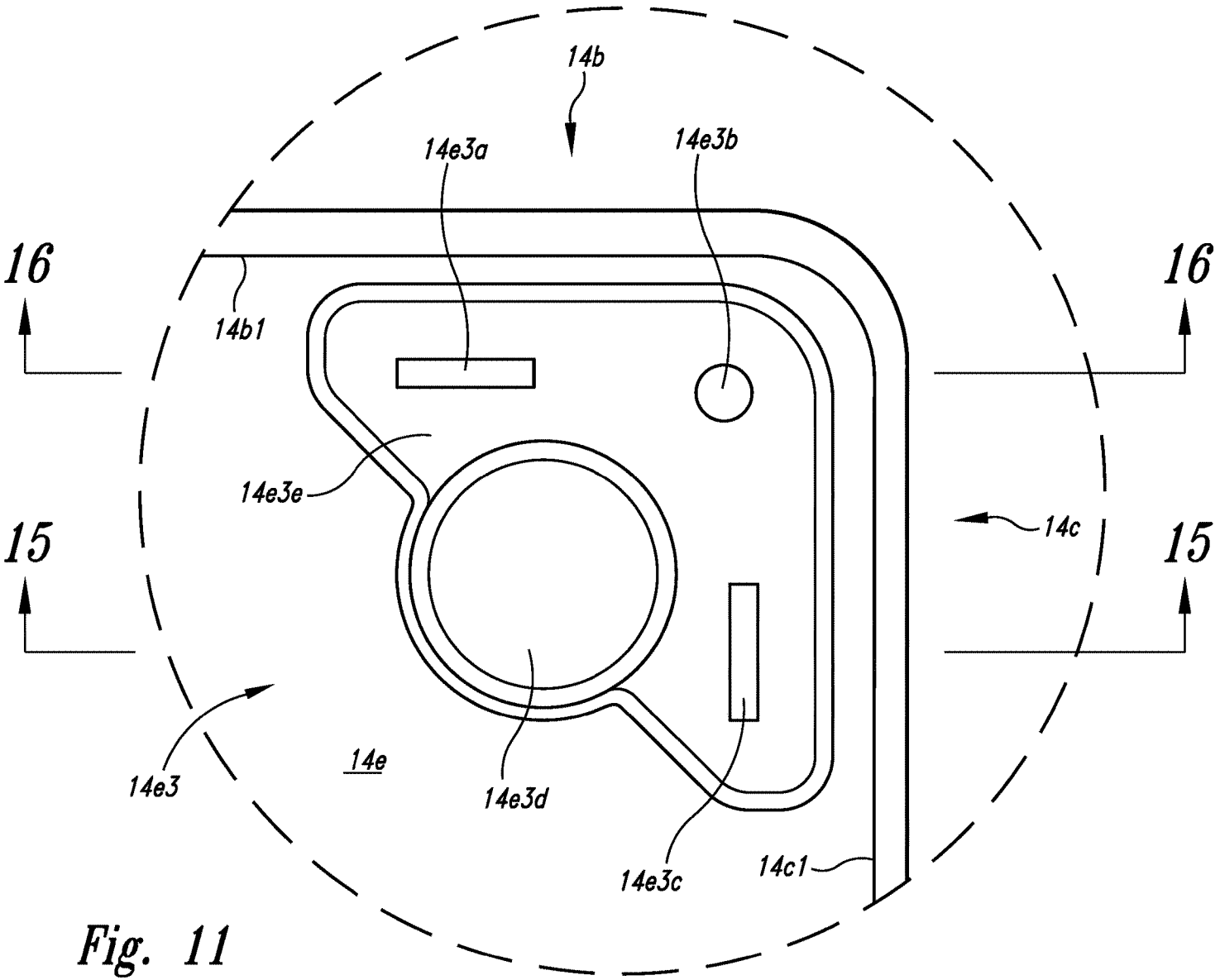
FIG. 11 is an enlarged top-plan view of a portion of the keyboard portion of FIG. 9 of the device case assembly of FIG. 2 taken along the dashed circle labeled "11" of FIG. 9.

Turning to FIG. 11, depicted therein is an enlarged top-plan view of a portion of keyboard containing portion 14 of device case assembly 10 taken along the dashed circle labeled "11" of FIG. 9. Implementations of corner assembly 14*e*3 of base interior surface 14*e* of corner assembly 14*e*3 is shown to include rectangular aperture 14*e*3*a*, circular aperture 14*e*3*b*, rectangular aperture 14*e*3*c*, circular feature 14*e*3*d*, and recessed surface 14*e*3*e*.

Figure 12:
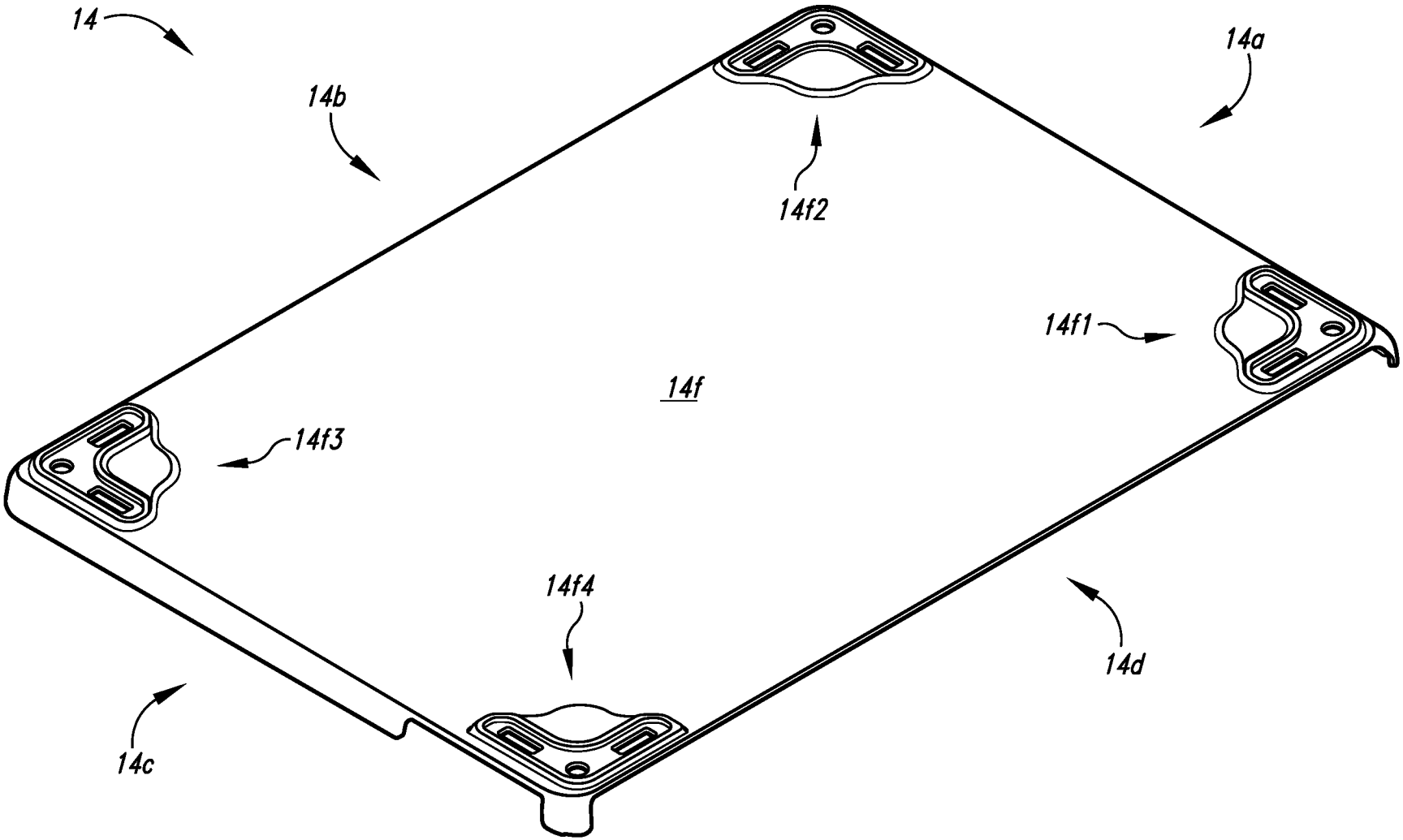
FIG. 12 is a rear perspective view of the keyboard portion of FIG. 9 of the device case assembly of FIG. 2.

Turning to FIG. 12, depicted therein is a rear perspective view of keyboard containing portion 14 of device case assembly 10. In implementations base exterior surface 14*f* of keyboard containing portion 14 is shown to include corner assembly 14*f*1, corner assembly 14*f*2, corner assembly 14*f*3, and corner assembly 14*f*4.

Figure 13:
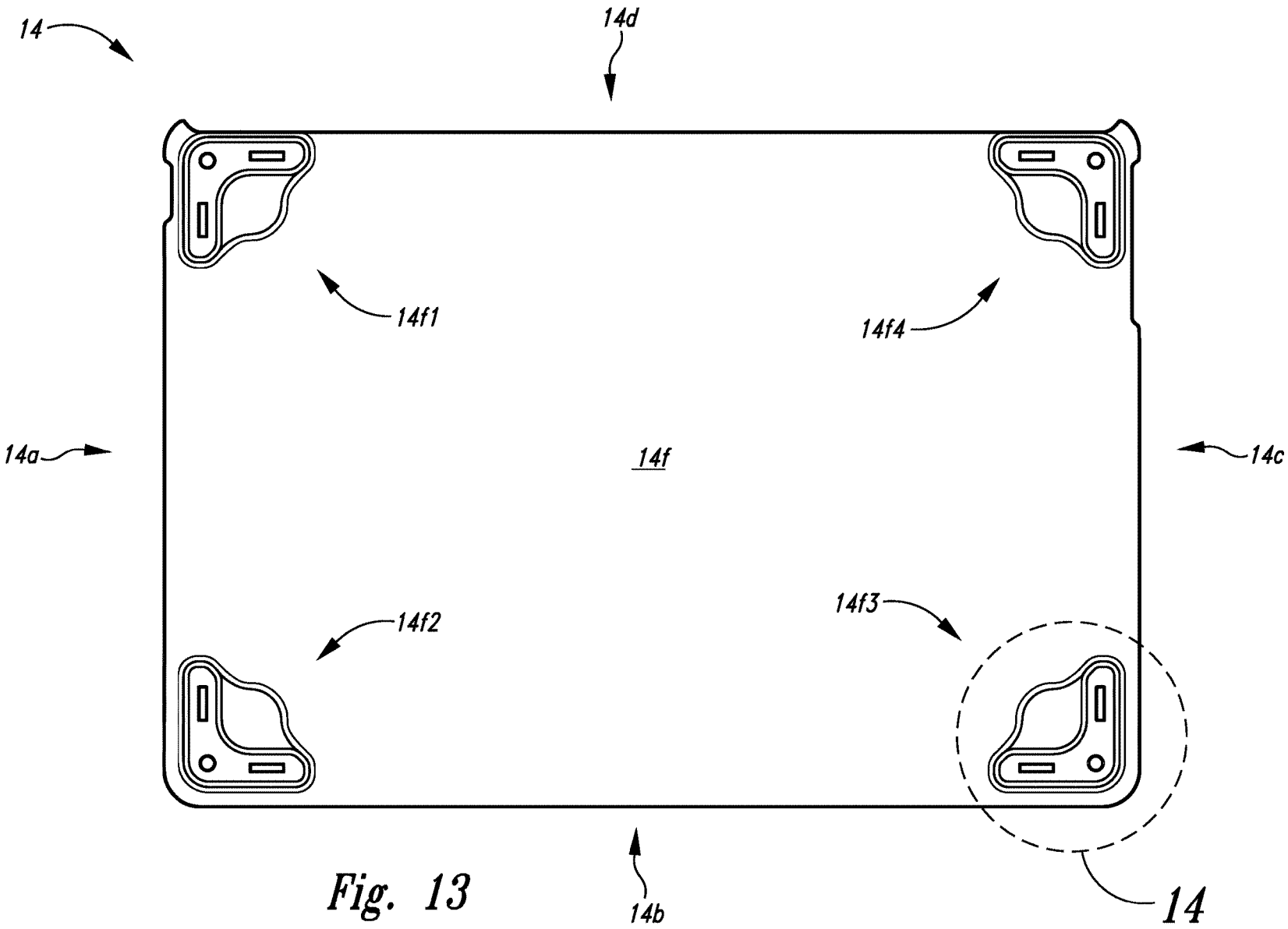
FIG. 13 is a bottom-plan view of the keyboard portion of FIG. 9 of the device case assembly of FIG. 2.

Turning to FIG. 13, depicted therein is a bottom-plan view of keyboard containing portion 14 of device case assembly 10.

Figure 14:
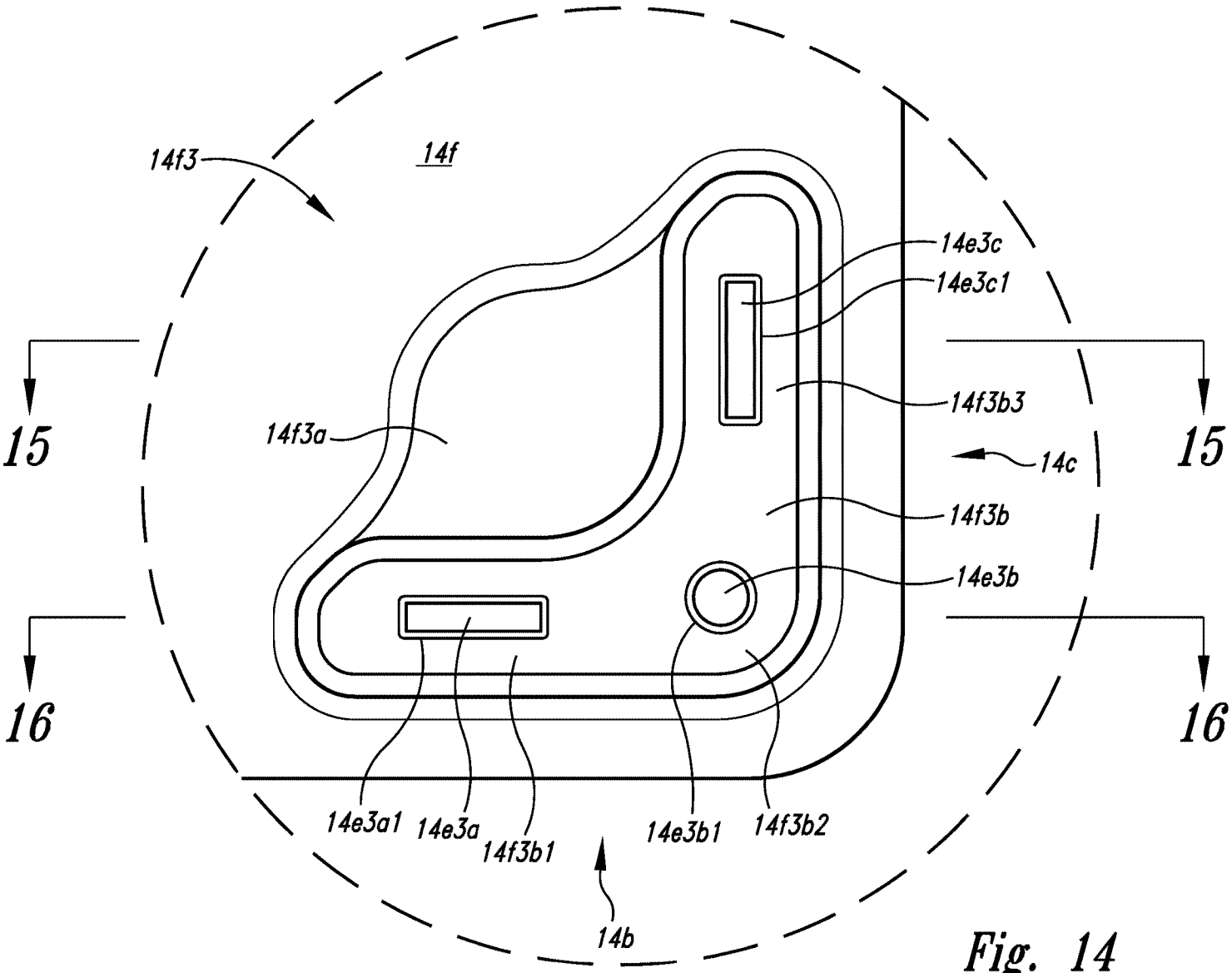
FIG. 14 is an enlarged bottom-plan view of a portion of the keyboard portion of FIG. 9 of the device case assembly of FIG. 2 taken along the dashed circle labeled "14" of FIG. 13.

Turning to FIG. 14, depicted therein is an enlarged bottom-plan view of a portion of keyboard containing portion 14 of device case assembly 10 taken along the dashed circle labeled "14" of FIG. 13. In implementations rectangular aperture 14*e*3*a*, circular aperture 14*e*3*b*, and rectangular aperture 14*e*3*c* of corner assembly 14*e*3 of base interior surface 14*e* of keyboard containing portion 14 include tapered surface 14*e*3*a*1, tapered surface 14*e*3*b*1, and tapered surface 14*e*3*c*1, respectively.

Figure 15:
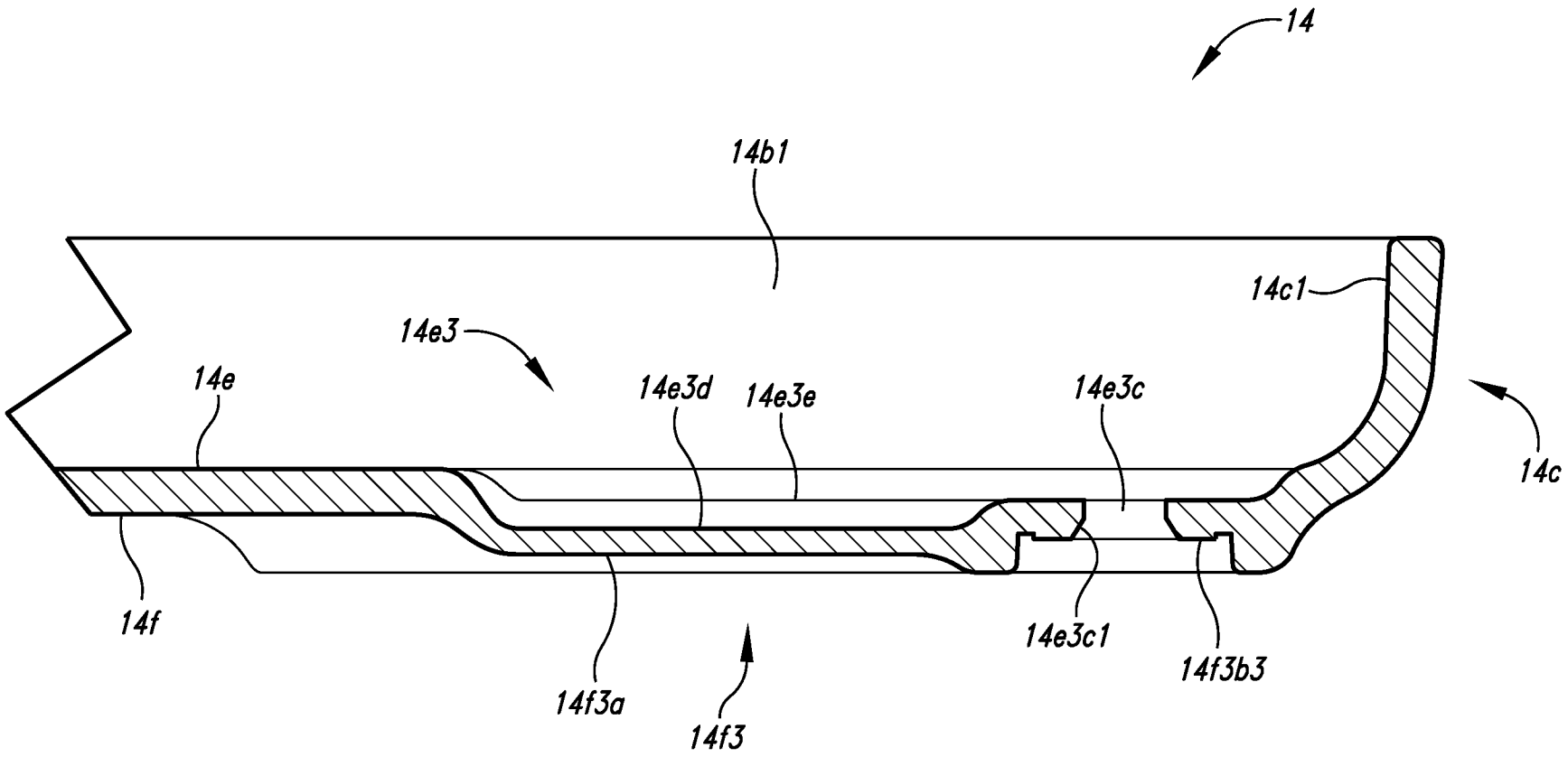
FIG. 15 is a cross-sectional view of a portion of the keyboard portion of FIG. 9 of the device case assembly of FIG. 2 taken along the 15-15 cut line of FIG. 14.

In implementations corner assembly 14*f*3 of base exterior surface 14*f* of keyboard containing portion 14 is shown to include recessed portion 14*f*3*a* and recessed interior surface 14*f*3*b*. In implementations recessed interior surface 14*f*3*b* is shown to include elongated recessed portion 14.14*f*3*b*1, Turning to FIG. 15, depicted therein is a cross-sectional view of a portion of keyboard containing portion 14 of device case assembly 10 taken along the 15-15 cut line of FIG. 14.

Figure 16:
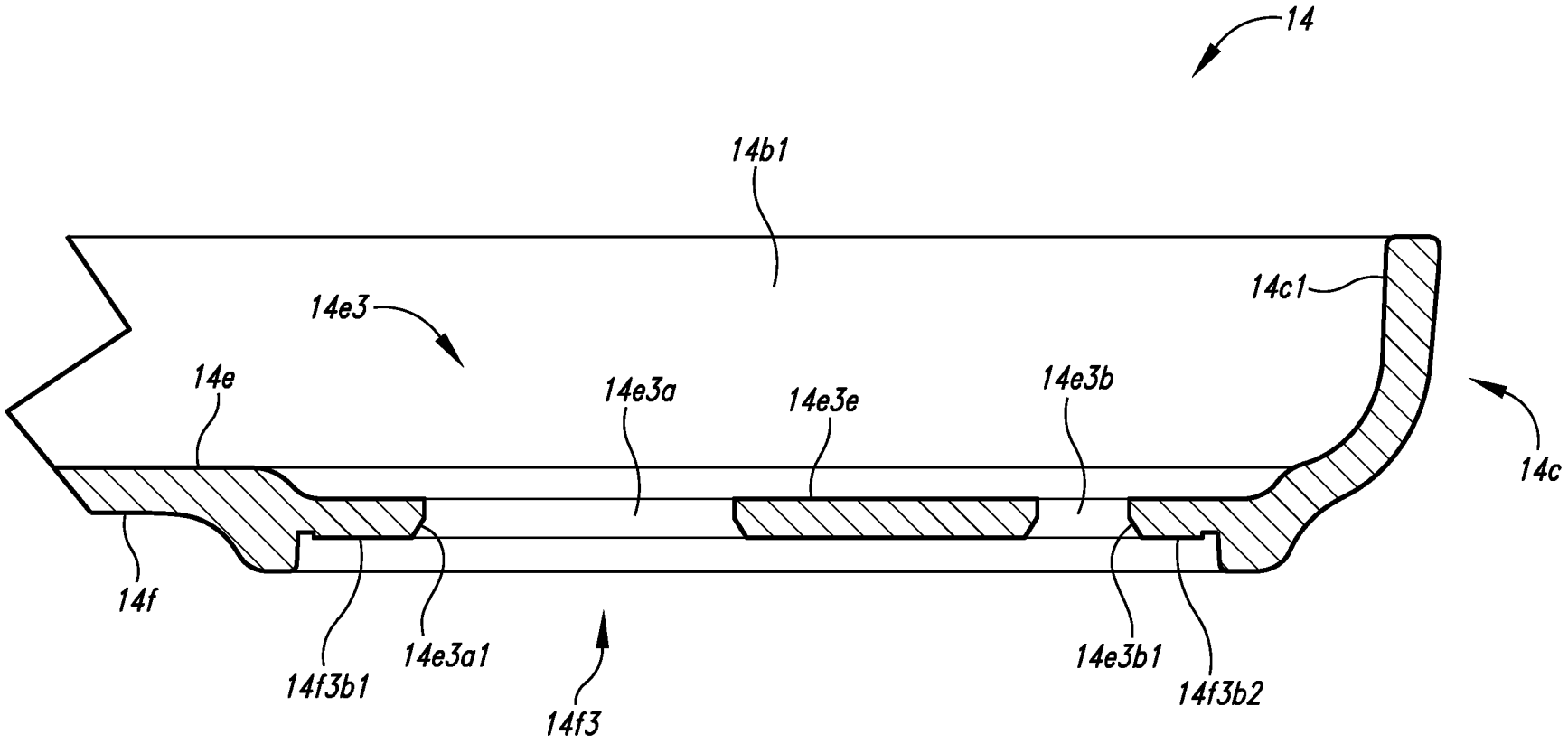
FIG. 16 is a cross-sectional view of a portion of the keyboard portion of FIG. 9 of the device case assembly of FIG. 2 taken along the 16-16 cut line of FIG. 14.

Turning to FIG. 16, depicted therein is a cross-sectional view of a portion of keyboard containing portion 14 of device case assembly 10 taken along the 16-16 cut line of FIG. 14.

Figure 17:
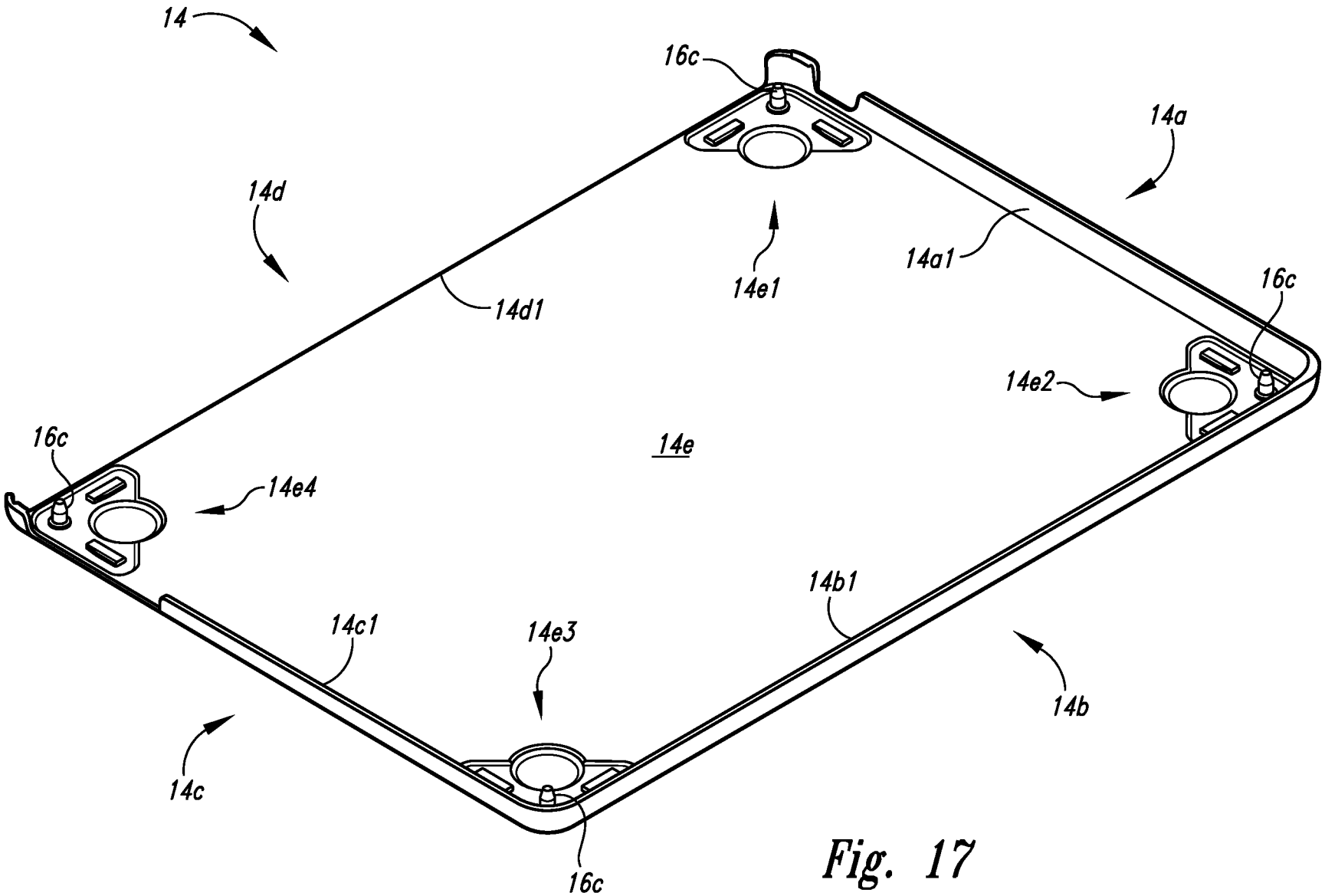
FIG. 17 is a front perspective view of the keyboard portion of FIG. 9 of the device case assembly of FIG. 2 shown coupled with a plurality of the bumper assembly of FIG. 4.

Turning to FIG. 17, depicted therein is a front perspective view of keyboard containing portion 14 of device case assembly 10 shown coupled with a plurality of the bumper assembly of FIG. 4.

Figure 18:
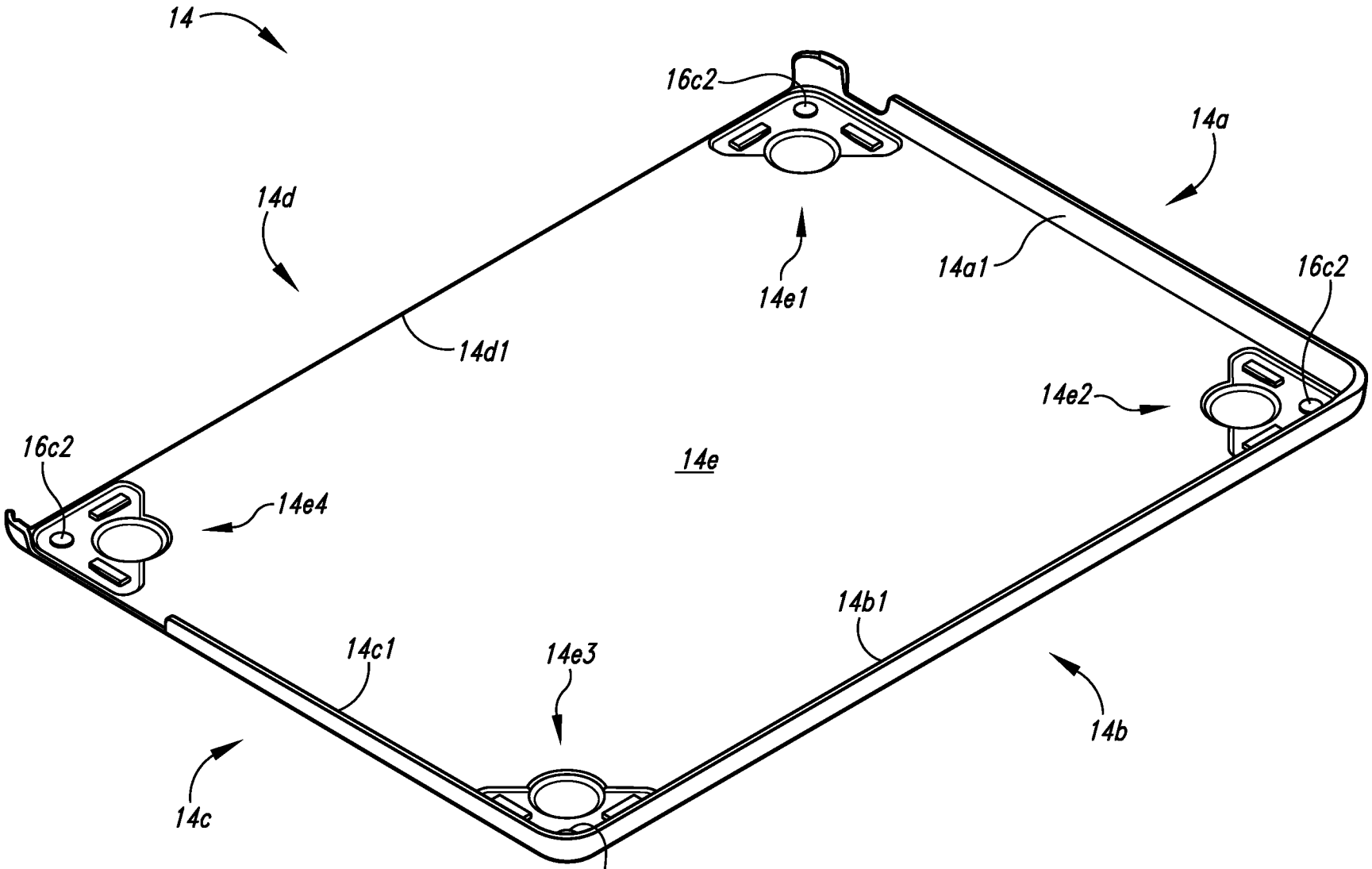
FIG. 18 is a front perspective view of the keyboard portion of FIG. 9 of the device case assembly of FIG. 2 shown coupled with a plurality of an abbreviated version of the bumper assembly of FIG. 4.

Turning to FIG. 18, depicted therein is a front perspective view of keyboard containing portion 14 of device case assembly 10 shown coupled with a plurality of an abbreviated version of bumper assembly 16, which has cylindrical portion 16*c*3, tapered cylindrical portion 16*c*4, and end portion 16c5 of engagement member 16c removed to fully expose circular flange 16c2 of engagement member 16c.

Figure 19:
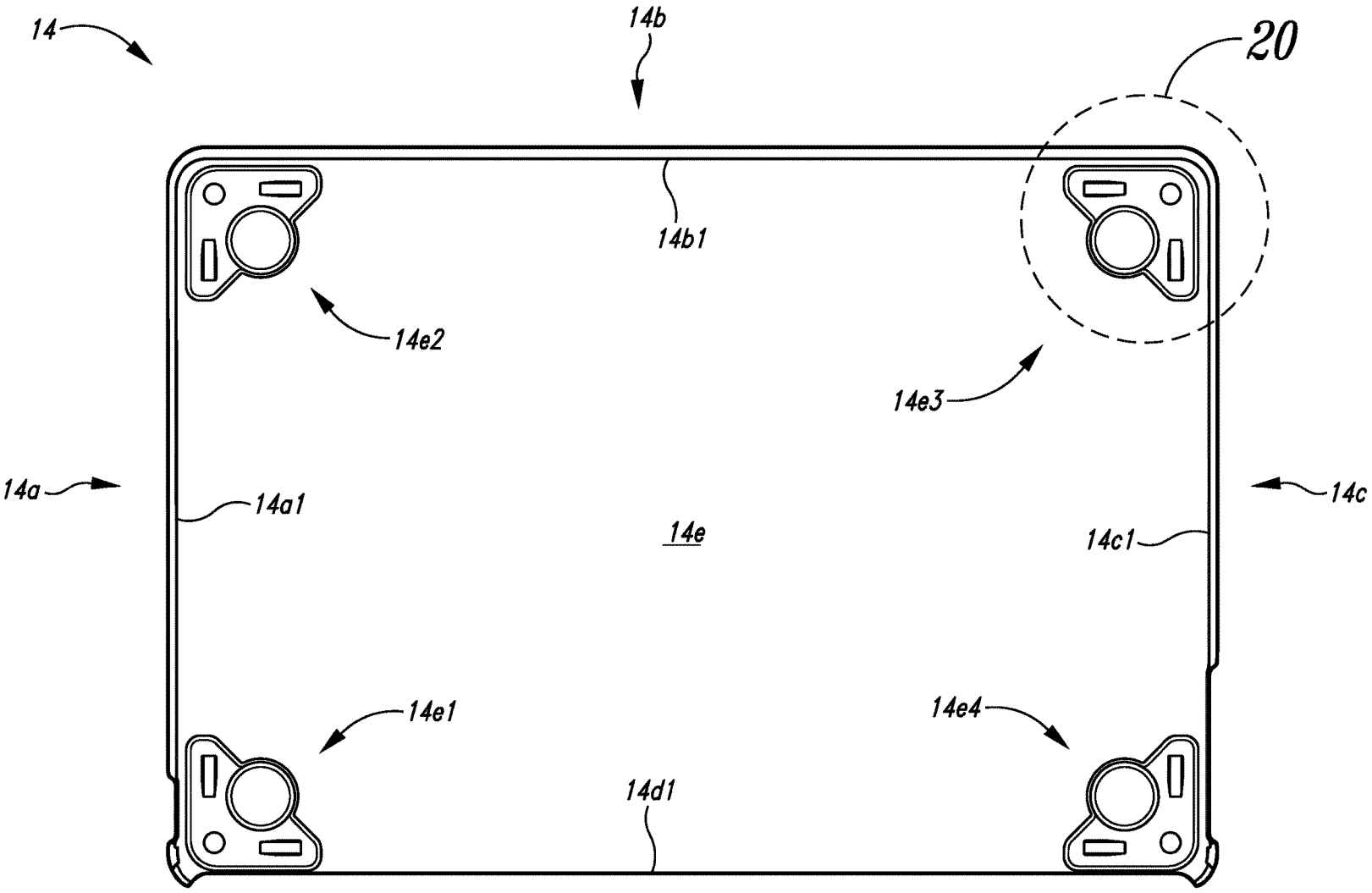
FIG. 19 is a top-plan view of the keyboard portion of FIG. 9 of the device case assembly of FIG. 2 shown coupled with a plurality of the abbreviated bumper assembly of FIG. 18.

Turning to FIG. 19, depicted therein is a top-plan view of keyboard containing portion 14 of device case assembly 10 shown coupled with a plurality of the abbreviated bumper assembly 16.

Figure 20:
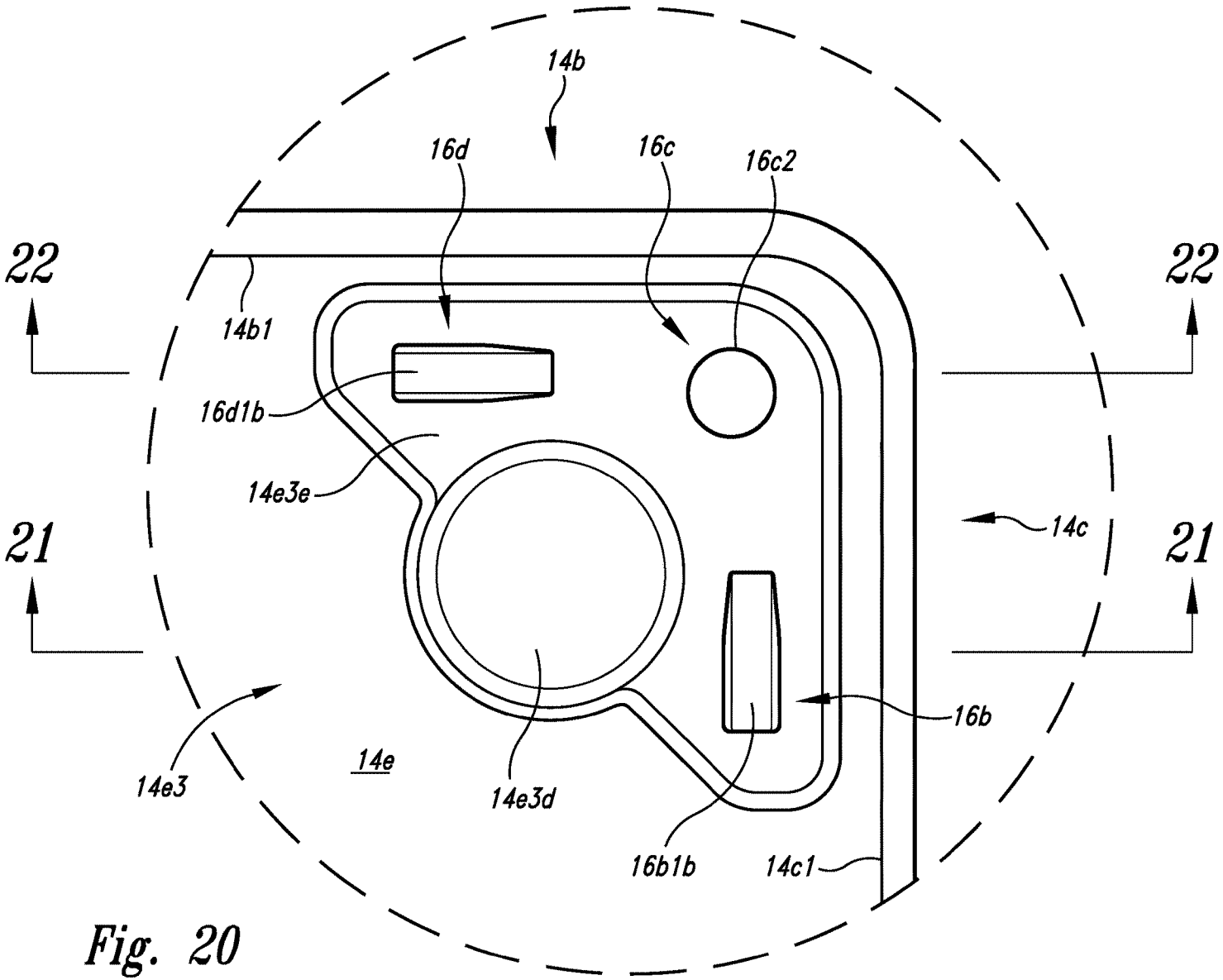
FIG. 20 is an enlarged top-plan view of a portion of the keyboard portion of FIG. 9 of the device case assembly of FIG. 2 taken along the dashed circle labeled "20" of FIG. 19 shown coupled with the abbreviated bumper assembly of FIG. 18.

Turning to FIG. 20, depicted therein is an enlarged top-plan view of a portion of keyboard containing portion 14 of device case assembly 10 taken along the dashed circle labeled "20" of FIG. 19 shown coupled with the abbreviated version of bumper assembly 16.

Figure 21:
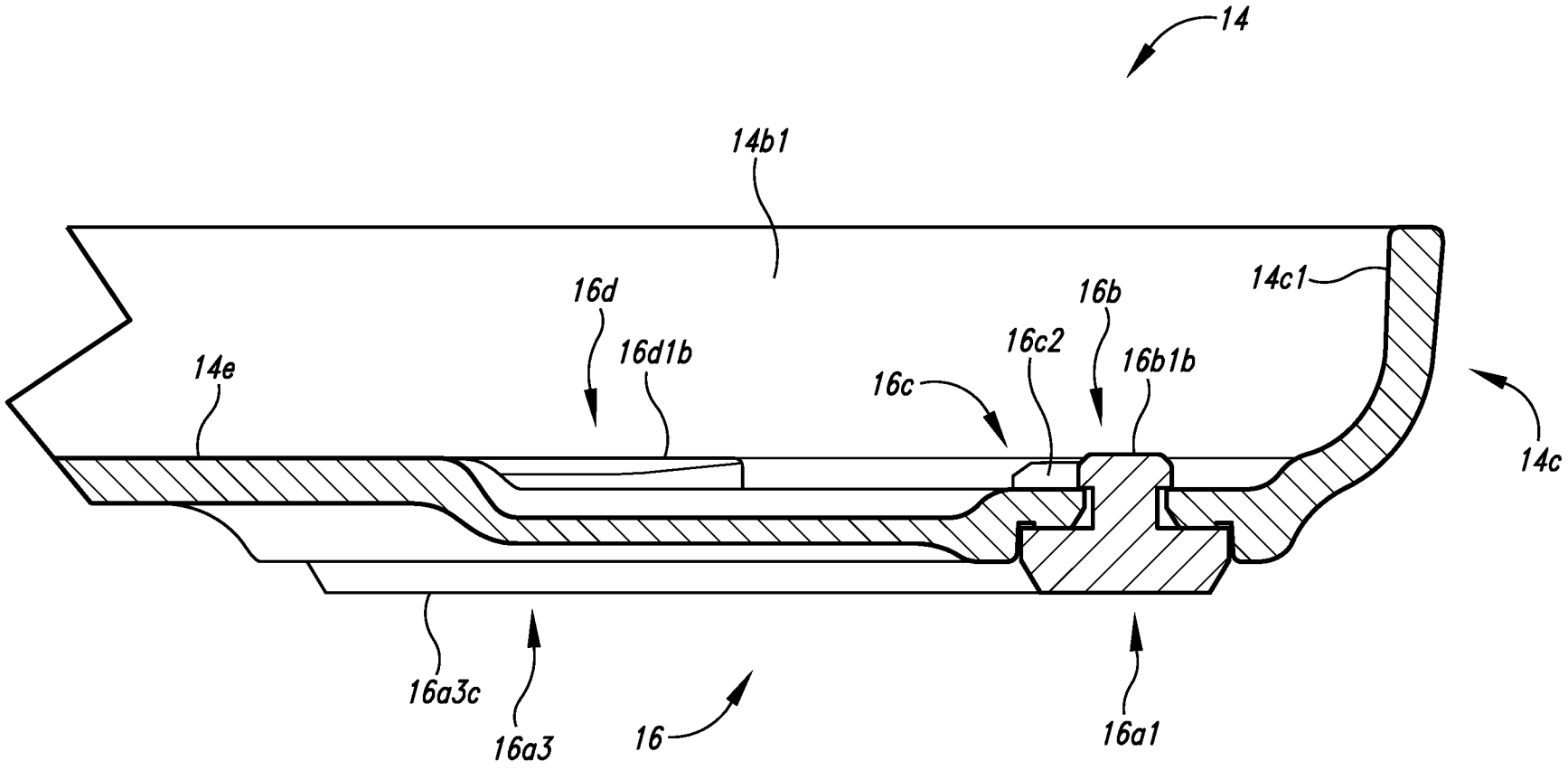
FIG. 21 is a cross-sectional view of a portion of the keyboard portion of FIG. 9 of the device case assembly of FIG. 2 shown coupled with the abbreviated bumper assembly of FIG. 18 taken along the 21-21 cut line of FIG. 20.

Turning to FIG. 21, depicted therein is a cross-sectional view of a portion of keyboard containing portion 14 of device case assembly 10 shown coupled with the abbreviated version of bumper assembly 16 taken along the 21-21 cut line of FIG. 20.

Figure 22:
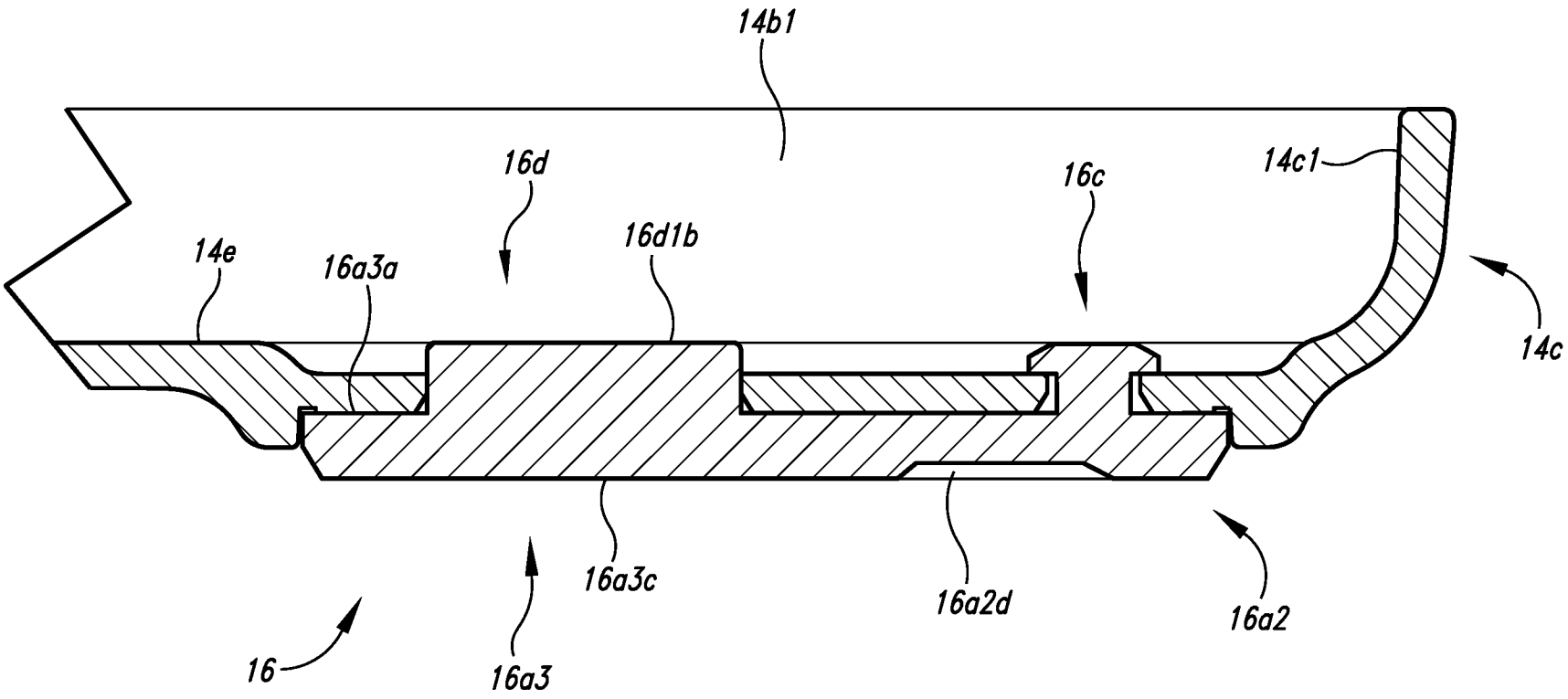
FIG. 22 is a cross-sectional view of a portion of the keyboard portion of FIG. 9 of the device case assembly of FIG. 2 shown coupled with the abbreviated bumper assembly of FIG. 18 taken along the 22-22 cut line of FIG. 20.

Turning to FIG. 22, depicted therein is a cross-sectional view of a portion of keyboard containing portion 14 of device case assembly 10 shown coupled with the abbreviated version of bumper assembly 16 taken along the 22-22 cut line of FIG. 20.

Figure 23:
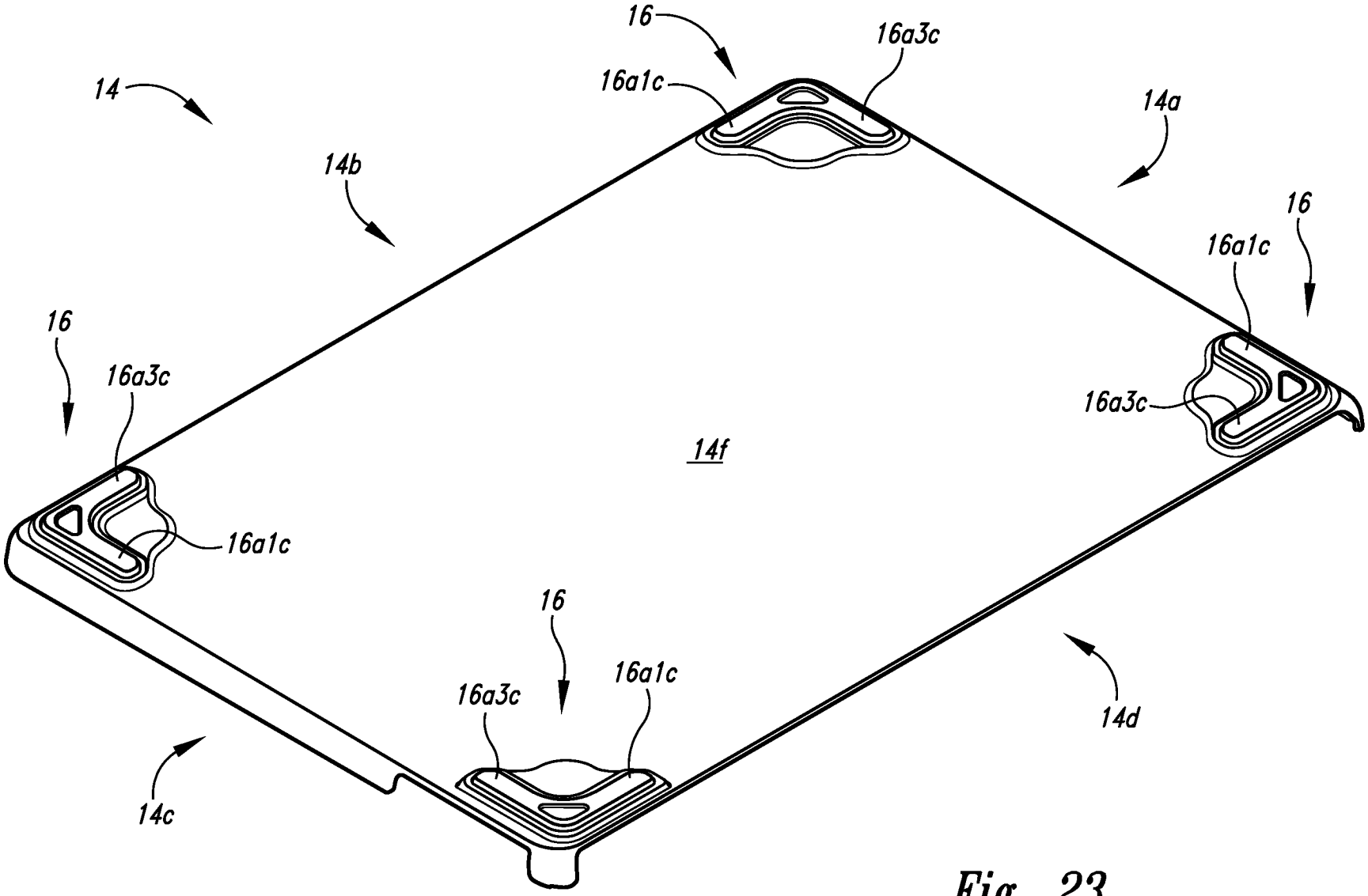
FIG. 23 is a rear perspective view of the keyboard portion of FIG. 9 of the device case assembly of FIG. 2 shown coupled with a plurality of the abbreviated bumper assembly of FIG. 18.

Turning to FIG. 23, depicted therein is a rear perspective view of keyboard containing portion 14 of device case assembly 10 shown coupled with a plurality the abbreviated version of bumper assembly 16.

Figure 24:
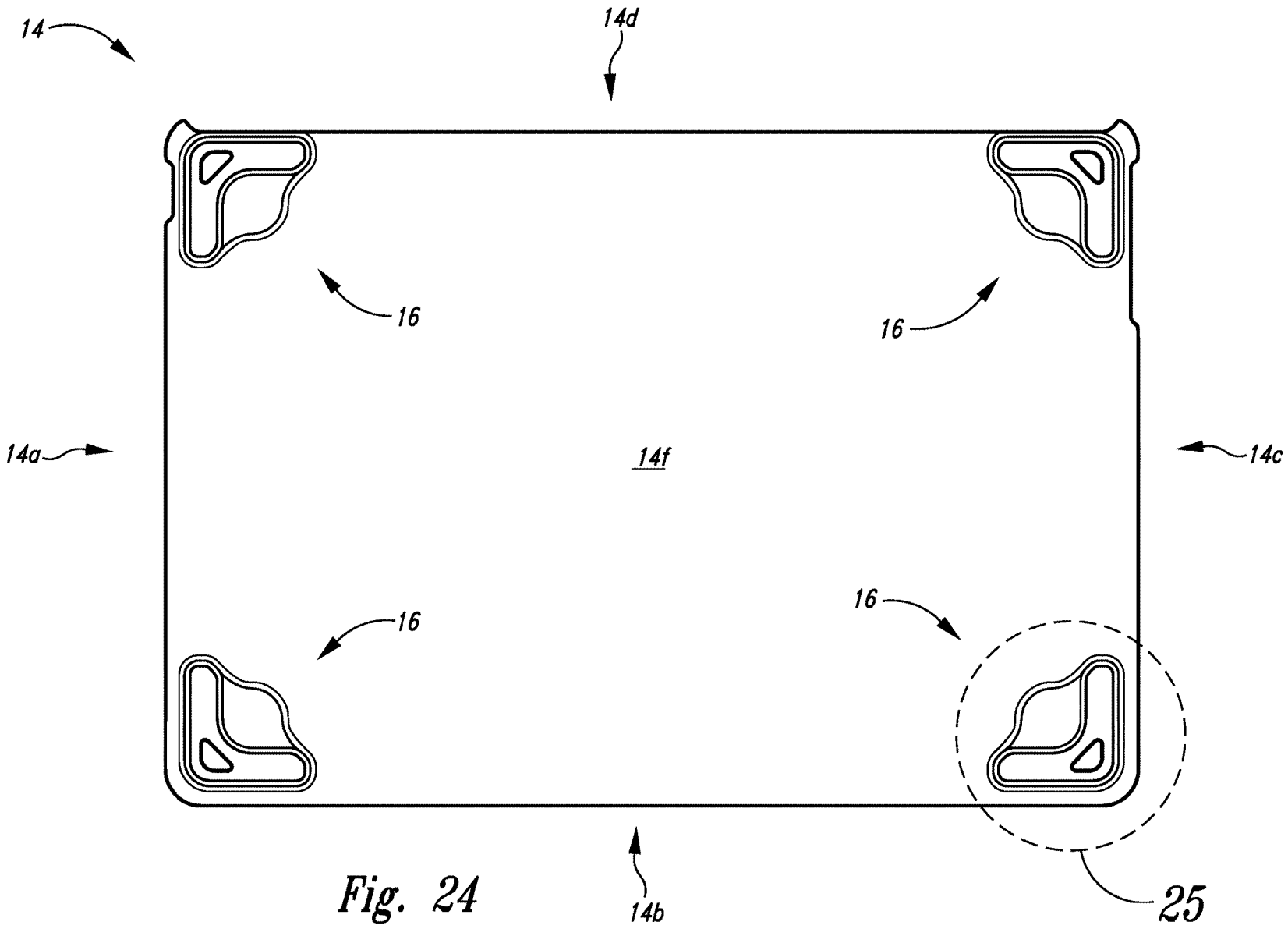
FIG. 24 is a bottom-plan view of the keyboard portion of FIG. 9 of the device case assembly of FIG. 2 shown coupled with a plurality of the abbreviated bumper assembly of FIG. 18.

Turning to FIG. 24, depicted therein is a bottom-plan view of keyboard containing portion 14 of device case assembly 10 shown coupled with a plurality of the abbreviated version of bumper assembly 16.

Figure 25:
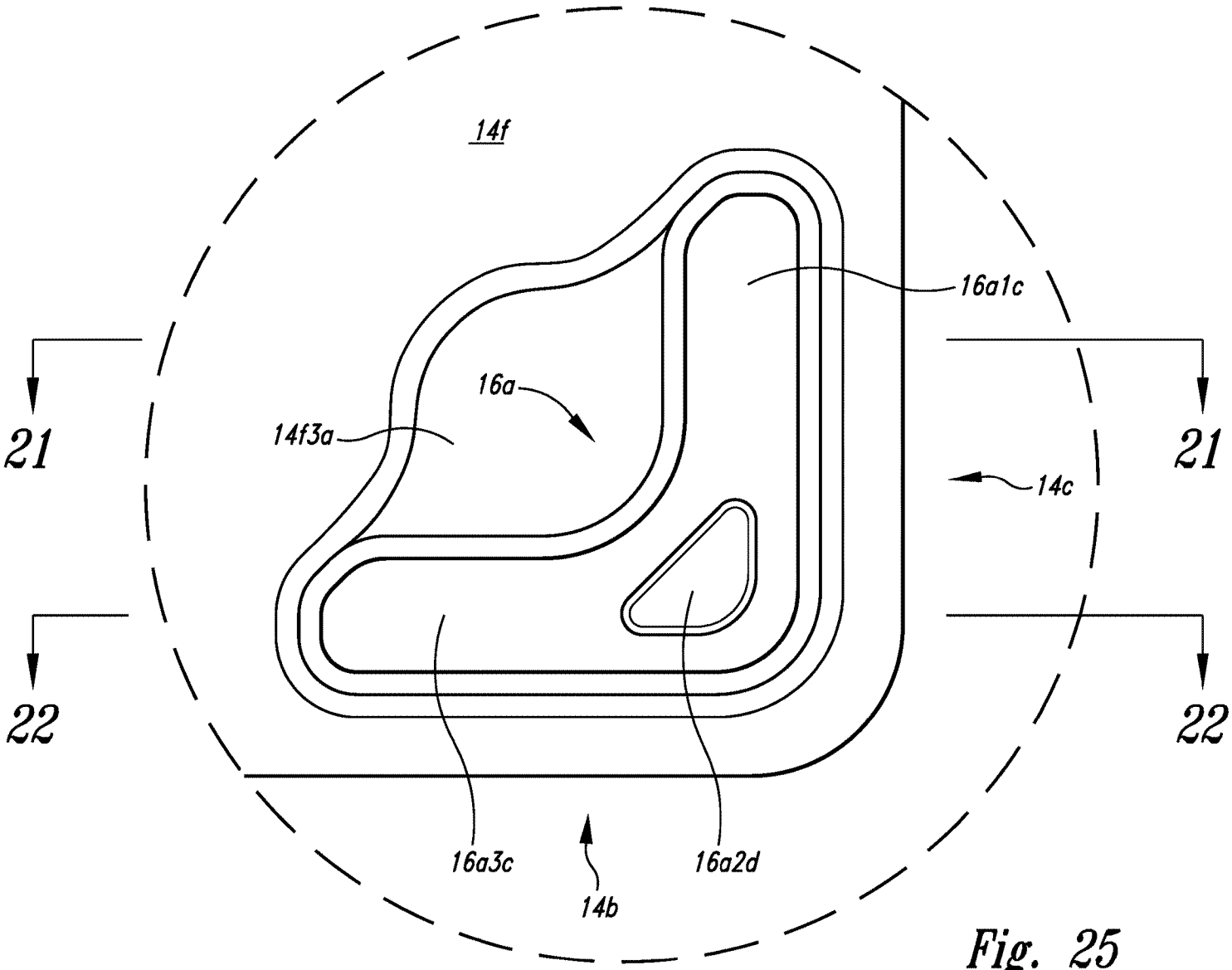
FIG. 25 is an enlarged bottom-plan view of a portion of the keyboard portion of FIG. 9 of the device case assembly of FIG. 2 shown coupled with the abbreviated bumper assembly of FIG. 18 taken along the dashed circle labeled "25" of FIG. 24.

Turning to FIG. 25, depicted therein is an enlarged bottom-plan view of a portion of keyboard containing portion 14 of device case assembly 10 shown coupled with the abbreviated version of bumper assembly 16 taken along the dashed circle labeled "25" of FIG. 24.

While particular aspects of the present subject matter described herein have been shown and described, it will be apparent to those skilled in the art that, based upon the teachings herein, changes and modifications may be made without departing from the subject matter described herein and its broader aspects and, therefore, the appended claims are to encompass within their scope all such changes and modifications as are within the true spirit and scope of the subject matter described herein. It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to claims containing only one such recitation, even when the same claim includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce claim recitations. In addition, even if a specific number of an introduced claim recitation is explicitly recited, those skilled in the art will recognize that such recitation should typically be interpreted to mean at least the recited number (e.g., the bare recitation of "two recitations," without other modifiers, typically means at least two recitations, or two or more recitations). Furthermore, in those instances where a convention analogous to "at least one of A, B, and C, etc." is used, in general such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.). In those instances where a convention analogous to "at least one of A, B, or C, etc." is used, in general such a construction is intended in the sense one having skill in the art would understand the convention (e.g., "a system having at least one of A, B, or C" would include but not be limited to systems that have A alone, B alone, C alone, A and B together, A and C together, B and C together, and/or A, B, and C together, etc.). It will be further understood by those within the art that typically a disjunctive word and/or phrase presenting two or more alternative terms, whether in the description, claims, or drawings, should be understood to contemplate the possibilities of including one of the terms, either of the terms, or both terms unless context dictates otherwise. For example, the phrase "A or B" will be typically understood to include the possibilities of "A" or "B" or "A and B."

With respect to the appended claims, those skilled in the art will appreciate that recited operations therein may generally be performed in any order. Also, although various operational flows are presented in a sequence(s), it should be understood that the various operations may be performed in other orders than those which are illustrated, or may be performed concurrently. Examples of such alternate orderings may include overlapping, interleaved, interrupted, reordered, incremental, preparatory, supplemental, simultaneous, reverse, or other variant orderings, unless context dictates otherwise. Furthermore, terms like "responsive to," "related to," or other past-tense adjectives are generally not intended to exclude such variants, unless context dictates otherwise.

What is claimed is:

1. A system for a portable electronic computing device, the system comprising:

(I) a case assembly including (A) at least one base including at least one interior base surface and at least one exterior base surface, (B) a first side including at least one first wall portion angularly extending relative to the at least one interior base surface, (C) a second side including at least one second wall portion angularly extending relative to the at least one interior base surface, and (D) a third side including at least one third wall portion angularly extending relative to the at least one interior base surface, wherein the at least one first wall portion extends perpendicularly to the second wall portion, wherein the at least one first wall portion extends parallel with the at least one third interior wall portion, and (E) at least one corner assembly including (i) at least one first aperture extending through the at least one interior base surface and the at least one exterior base surface, and (ii) at least one second aperture extending through the at least one interior base surface and the at least one exterior base surface, wherein the at least one first aperture includes a first plan-view shape and the at least one second aperture includes a second plan-view shape, the first plan-view shape of the first aperture being different that the second plan-view shape of the second aperture; and (II) at least one bumper assembly including at least one first engagement member sized and shaped to couple with the at least one first aperture and the at least one second engagement member sized and shaped to couple with the at least one second aperture, wherein the at least one corner assembly being positioned equidistant from the at least one first wall portion and the at least one second wall portion, and wherein the at least one second aperture being positioned equidistant from the at least one first wall portion and from the at least one second wall portion.

2. The system of claim 1 wherein the first plan-view shape of the at least one first aperture being rectangular in shape.

3. The system of claim 1 wherein the second plan-view shape of the at least one second aperture being circular in shape.

4. The system of claim 1 wherein the at least one corner assembly being positioned equidistant from the at least one first wall portion and the at least one second wall portion, and wherein the at least one first aperture being positioned closer to the at least one first wall portion than the at least one second wall portion.

5. A system for a portable electronic computing device, the system comprising:

(I) a case assembly including (A) at least one base including at least one interior base surface and at least one exterior base surface, (B) a first side including at least one first wall portion angularly extending relative to the at least one interior base surface, (C) a second side including at least one second wall portion angularly extending relative to the at least one interior base surface, and (D) a third side including at least one third wall portion angularly extending relative to the at least one interior base surface, wherein the at least one first wall portion extends perpendicularly to the second wall portion, wherein the at least one first wall portion extends parallel with the at least one third interior wall portion, and (E) at least one corner assembly including (i) at least one first aperture extending through the at least one interior base surface and the at least one exterior base surface, and (ii) at least one second aperture extending through the at least one interior base surface and the at least one exterior base surface, wherein the at least one first aperture includes a first plan-view shape and the at least one second aperture includes a second plan-view shape, the first plan-view shape of the first aperture being different that the second plan-view shape of the second aperture; and (II) at least one bumper assembly including at least one first engagement member sized and shaped to couple with the at least one first aperture and the at least one second engagement member sized and shaped to couple with the at least one second aperture, wherein the at least one interior base surface includes at least one first surface and at least one second surface, wherein the at least one first aperture extending through the at least one second surface and the at least one second aperture extending through the at least one second surface, and wherein the at least one second surface being recessed from the at least one first surface sufficiently to allow any portion of the at least one first engagement member and any portion of the at least one second engagement member to refrain from being parallel with any portion of the first wall portion, the second wall portion, and the third wall portion.

6. The system of claim 5 wherein the at least one bumper assembly includes a first elongated portion, a second elongated portion, and a corner portion, and wherein the first elongated portion extends from the corner portion in a first direction, and the second elongated portion extends from the corner portion in a second direction perpendicular to the first direction.

7. The system of claim 6 wherein at least one of the at least one first engagement member extends from the first elongated portion of the at least one bumper assembly and at least one of the at least one first engagement member extends from the second elongated portion of the at least one bumper assembly, and wherein the at least one second engagement member extend from the corner portion of the at least one bumper assembly.

8. A system for a portable electronic computing device, the system comprising:

(I) a case assembly including (A) at least one base including at least one interior base surface and at least one exterior base surface, (B) a first side including at least one first wall portion angularly extending relative to the at least one interior base surface, (C) a second side including at least one second wall portion angularly extending relative to the at least one interior base surface, and (D) a third side including at least one third wall portion angularly extending relative to the at least one interior base surface, wherein the at least one first wall portion extends perpendicularly to the second wall portion, wherein the at least one first wall portion extends parallel with the at least one third interior wall portion, and (E) at least one corner assembly including (i) at least one first aperture extending through the at least one interior base surface and the at least one exterior base surface, and (ii) at least one second aperture extending through the at least one interior base surface and the at least one exterior base surface, wherein the at least one first aperture includes a first plan-view shape and the at least one second aperture includes a second plan-view shape, the first plan-view shape of the first aperture being different that the second plan-view shape of the second aperture; and (II) at least one bumper assembly including at least one first engagement member sized and shaped to couple with the at least one first aperture and the at least one second engagement member sized and shaped to couple with the at least one second aperture, wherein the at least one exterior base surface includes at least one first surface and at least one second surface, wherein the at least one first aperture extending through the at least one second surface and the at least one second aperture extending through the at least one second surface, and wherein the at least one second surface being recessed from the at least one first surface sufficiently to allow at least one portion of the at least one bumper assembly other than the at least one first engagement member and other than the at least one second engagement member to be recessed from the at least one first surface when the at least one bumper assembly is coupled with the case assembly.

9. The system of claim 8 wherein at least one the first engagement portion of the at least one bumper assembly includes at least one rectangular portion.

10. The system of claim 9 wherein the at least one first engagement portion of the at least one bumper assembly includes at least one flange extending from and along the at least one rectangular portion of the at least one first engagement portion.

11. The system of claim 8 wherein the at least one second engagement portion of the at least one bumper assembly includes at least one cylindrical portion.

12. The system of claim 8 wherein a first of the at least one first engagement member being positioned adjacent to and extending away from the at least one second engagement member in a first direction, and wherein a second of the at least one first engagement member being positioned adjacent to and extending away from the at least one second engagement member in a second direction perpendicular to the first direction.

13. The system of claim 8 wherein the at least one second engagement member includes a circular flange portion, and wherein the at least one second engagement member includes a beveled circular portion as an end portion.

14. The system of claim 8 wherein the at least one second engagement member includes a circular flange portion as an end portion.

15. A system for a portable electronic computing device, the system comprising:

(I) a case assembly including (A) at least one base including at least one interior base surface and at least one exterior base surface, (B) a first side including at least one first wall portion angularly extending relative to the at least one interior base surface, (C) a second side including at least one second wall portion angularly extending relative to the at least one interior base surface, and (D) a third side including at least one third wall portion angularly extending relative to the at least one interior base surface, wherein the at least one first wall portion extends perpendicularly to the second wall portion, wherein the at least one first wall portion extends parallel with the at least one third interior wall portion, and (E) at least one corner assembly including (i) at least one first aperture extending through the at least one interior base surface and the at least one exterior base surface, and (ii) at least one second aperture extending through the at least one interior base surface and the at least one exterior base surface, wherein the at least one first aperture includes a rectangular plan-view shape and the at least one second aperture includes a circular plan-view shape, wherein the at least one corner assembly being positioned equidistant from the at least one first wall portion and the at least one second wall portion, wherein the at least one first aperture being positioned closer to the at least one first wall portion than the at least one second wall portion, and wherein the at least one second aperture being positioned equidistant from the at least one first wall portion and from the at least one second wall portion.

16. A system for a portable electronic computing device, the system comprising:

(I) a case assembly including (A) at least one base including at least one interior base surface and at least one exterior base surface, (B) a first side including at least one first wall portion angularly extending relative to the at least one interior base surface, (C) a second side including at least one second wall portion angularly extending relative to the at least one interior base surface, and (D) a third side including at least one third wall portion angularly extending relative to the at least one interior base surface, wherein the at least one first wall portion extends perpendicularly to the second wall portion, wherein the at least one first wall portion extends parallel with the at least one third interior wall portion, and (E) at least one corner assembly including (i) at least one first aperture extending through the at least one interior base surface and the at least one exterior base surface, and (ii) at least one second aperture extending through the at least one interior base surface and the at least one exterior base surface, wherein the at least one first aperture includes a rectangular plan-view shape and the at least one second aperture includes a circular plan-view shape, wherein the at least one interior base surface includes at least one first surface and at least one second surface, wherein the at least one first aperture extending through the at least one second surface and the at least one second aperture extending through the at least one second surface, and wherein the at least one second surface being recessed from the at least one first surface.

17. A system for a portable electronic computing device, the system comprising:

(I) a case assembly including (A) at least one base including at least one interior base surface and at least one exterior base surface, and (E) at least one corner assembly including (i) at least one first aperture extending through the at least one interior base surface and the at least one exterior base surface, and (ii) at least one second aperture extending through the at least one interior base surface and the at least one exterior base surface, wherein the at least one first aperture includes a first plan-view shape and the at least one second aperture includes a second plan-view shape, the first plan-view shape of the first aperture being different that the second plan-view shape of the second aperture; and (II) at least one bumper assembly including at least one first engagement member sized and shaped to couple with the at least one first aperture and the at least one second engagement member sized and shaped to couple with the at least one second aperture, wherein the at least one bumper assembly includes a first elongated portion, a second elongated portion, and a corner portion, and wherein the first elongated portion extends from the corner portion in a first direction, and the second elongated portion extends from the corner portion in a second direction perpendicular to the first direction, wherein at least one of the at least one first engagement member extends from the first elongated portion of the at least one bumper assembly and at least one of the at least one first engagement member extends from the second elongated portion of the at least one bumper assembly, and wherein the at least one second engagement member extend from the corner portion of the at least one bumper assembly.

* * * * *